US010953556B2

(12) United States Patent
Tuch

(10) Patent No.: US 10,953,556 B2
(45) Date of Patent: Mar. 23, 2021

(54) SWITCHBLADES

(71) Applicant: William R. Tuch, Portland, OR (US)

(72) Inventor: William R. Tuch, Portland, OR (US)

( * ) Notice: Subject to any disclaimer, the term of this patent is extended or adjusted under 35 U.S.C. 154(b) by 0 days.

(21) Appl. No.: 16/536,666

(22) Filed: Aug. 9, 2019

(65) Prior Publication Data

US 2020/0047356 A1 Feb. 13, 2020

Related U.S. Application Data

(60) Provisional application No. 62/717,278, filed on Aug. 10, 2018.

(51) Int. Cl.
*B26B 1/04* (2006.01)
*B26B 1/10* (2006.01)

(52) U.S. Cl.
CPC ..... *B26B 1/04* (2013.01); *B26B 1/10* (2013.01); *B26B 1/042* (2013.01)

(58) Field of Classification Search
CPC ..... B26B 1/04; B26B 1/10; B26B 1/042
See application file for complete search history.

(56) References Cited

U.S. PATENT DOCUMENTS 6,145,202 A 11/2000 Onion
6,918,184 B2 * 7/2005 Glesser ..... B26B 1/04 30/161
7,246,441 B1 7/2007 Collins
7,739,799 B2 * 6/2010 Van Deursen ..... B26B 1/04 30/142
7,886,444 B2 * 2/2011 Kao ..... B26B 1/044 30/159
8,443,521 B2 * 5/2013 Klecker ..... B26B 1/10 30/155
8,939,054 B2 1/2015 Hawk et al.
9,943,970 B2 * 4/2018 Glesser ..... B26B 1/048
10,220,527 B1 3/2019 Marfione
10,272,576 B2 * 4/2019 Onion ..... B26B 1/04
2002/0029481 A1 * 3/2002 Eickhorn ..... B26B 1/042 30/161

(Continued)

OTHER PUBLICATIONS

"Vallotton Custom Knives—Welcome to Knife Country." valknives.com. Vallotton Custom Knives, Jul. 17, 2019. www.valknives.com/automatics.html.

(Continued)

*Primary Examiner* — Omar Flores Sanchez
(74) *Attorney, Agent, or Firm* — Dascenzo Gates Intellectual Property Law, P.C.

(57) ABSTRACT

Switchblades are disclosed herein. A switchblade includes a handle body, a blade pivotally coupled to the handle body, and a release mechanism for pivoting the blade about a blade pivot axis to transition the blade from a folded position to a deployed position. The release mechanism includes a release spring, a sear, and an actuator. The release spring is configured to transition from a retained configuration to a released configuration to drive the blade from the folded position to the deployed position. The sear is configured to retain the release spring in the retained configuration while the sear is in a retaining position. The actuator includes an actuator arm that is configured to move relative to a portion of the handle body to transition the sear from the retaining position to a releasing position.

20 Claims, 9 Drawing Sheets

(56) References Cited

U.S. PATENT DOCUMENTS

2008/0222897 A1 9/2008 Marfione et al.
2009/0183374 A1* 7/2009 Kao ..... B26B 1/044 30/159
2011/0119926 A1* 5/2011 Klecker ..... B26B 1/10 30/161
2012/0144677 A1* 6/2012 Chang ..... B26B 1/044 30/161
2013/0047439 A1* 2/2013 Hawk ..... B26B 1/04 30/160
2013/0212887 A1* 8/2013 De Buyer-Mimeure ..... B26B 1/04 30/161
2014/0115900 A1* 5/2014 Ikoma ..... B26B 1/042 30/161
2016/0052151 A1* 2/2016 Chu ..... B26B 1/04 30/161
2016/0136824 A1* 5/2016 Glesser ..... B26B 1/048 30/161
2017/0341243 A1* 11/2017 Sheahan ..... B67B 7/04
2018/0133907 A1* 5/2018 Kao ..... B26B 1/04
2018/0169874 A1 6/2018 Halucha
2019/0143545 A1* 5/2019 Hagstrom ..... B26B 1/042 30/408
2020/0130203 A1* 4/2020 Wang ..... B26B 5/00

OTHER PUBLICATIONS

"Diskin Fire Custom D/A Dual-Action Automatic Carbon Fiber—Blade HQ." bladehq.com. Blade HQ, Jul. 17, 2019. www.bladehq.com/item--Diskin-Fire-Custom-DA-Dual-Action--26602.
"Microtech Lightfoot LCC D/A Automatic Knife Carbon Fiber—Blade HQ." bladehq.com. Blade HQ, Jul. 17, 2019. www.bladehq.com/item--Microtech-Lightfoot-Compact-Combat--9555.
"Protech Harkins ATAC D/A Automatic Knife Cocobolo—Blade HQ." bladehq.com. Blade HQ, Jul. 17, 2019. www.bladehq.com/item--Protech-Harkins-ATAC-DA-Automatic--71642.
"Reese Weiland Prototype Italian Dual-Action Automatic Knife—Blade HQ." bladehq.com. Blade HQ, Jul. 17, 2019. www.bladehq.com/item--Reese-Weiland-Prototype-Italian--28992.

* cited by examiner

SWITCHBLADES

RELATED APPLICATION

This application claims priority under 35 U.S.C § 119(e) to U.S. Provisional Patent Application Ser. No. 62/717,278, which was filed on Aug. 10, 2018, the complete disclosure of which is hereby incorporated by reference.

FIELD

The present disclosure relates to switchblades.

BACKGROUND

A switchblade is a knife, such as a folding knife, in which a cutting edge of a blade is selectively exposed from a handle of the knife via a release of potential energy, such as may be stored in a spring in the knife. As an example, a folding switchblade may include a leaf spring that is retained in a flexed state by a sear that is selectively actuated to release the spring. When the spring is released, the potential energy previously stored in the spring pivots the blade out of the handle to expose a cutting edge of the blade. In some examples of folding switchblades, the sear may be actuated to release the spring via a button or linear slide mechanism.

SUMMARY

Switchblades are disclosed herein. A switchblade includes a handle body, a blade pivotally coupled to the handle body and having a cutting edge, and a release mechanism for selectively transitioning the blade from a folded position to a deployed position. The handle body includes a first body portion and a second body portion, each of which partially defines a blade receiver region between the first body portion and the second body portion. When the blade is in the folded position, the cutting edge of the blade is at least substantially received within the blade receiver region. When the blade is in the deployed position, the cutting edge is exposed and the blade substantially extends from the handle body. The blade is configured to pivot relative to the handle body about a blade pivot axis to transition the blade between the folded position and the deployed position, and extends at least substantially within a blade plane that is at least substantially perpendicular to the blade pivot axis as the blade transitions between the folded position and the deployed position.

The release mechanism includes a release spring, a sear, and an actuator. The release spring is configured to drive the blade from the folded position to the deployed position. The release spring is configured to be selectively transitioned between a retained configuration and a released configuration. The sear is configured to selectively retain the release spring in the retained configuration, and is configured to pivot about a sear pivot axis that is at least substantially parallel to the blade pivot axis to selectively transition the sear between a retaining position and a releasing position. The release mechanism is configured to enable the release spring to transition from the retained configuration to the released configuration responsive to the sear transitioning from the retaining position to the releasing position. The actuator is configured to transition the sear from the retaining position to the releasing position. The actuator includes an actuator arm that is configured to move relative to at least a portion of the handle body to selectively transition the actuator between a nominal configuration and an actuated configuration. The release mechanism is configured to transition the sear from the retaining position to the releasing position responsive to the actuator transitioning from the nominal configuration to the actuated configuration.

DETAILED DESCRIPTION

FIGS. 1-13 provide examples of switchblades 100 according to the present disclosure. Elements that serve a similar, or at least substantially similar, purpose are labeled with like numbers in each of FIGS. 1-13, and these elements may not be discussed in detail herein with reference to each of FIGS. 1-13. Similarly, all elements may not be labeled in each of FIGS. 1-13, but reference numbers associated therewith may be utilized herein for consistency. Elements, components, and/or features that are discussed herein with reference to one or more of FIGS. 1-13 may be included in and/or utilized with any of FIGS. 1-13 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Figure 1:
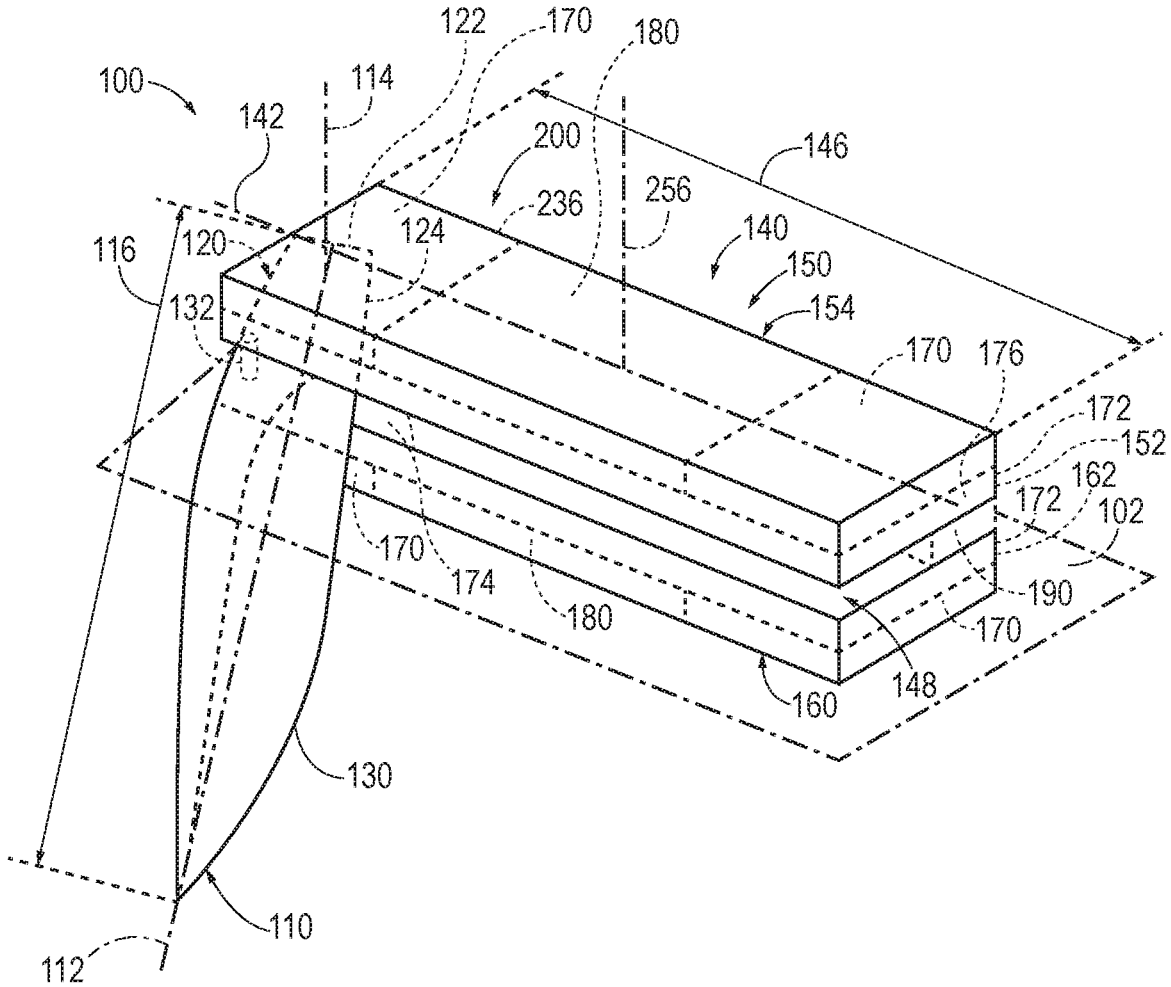
FIG. 1 is a schematic top side isometric view illustrating examples of switchblades according to the present disclosure.
Figure 2:
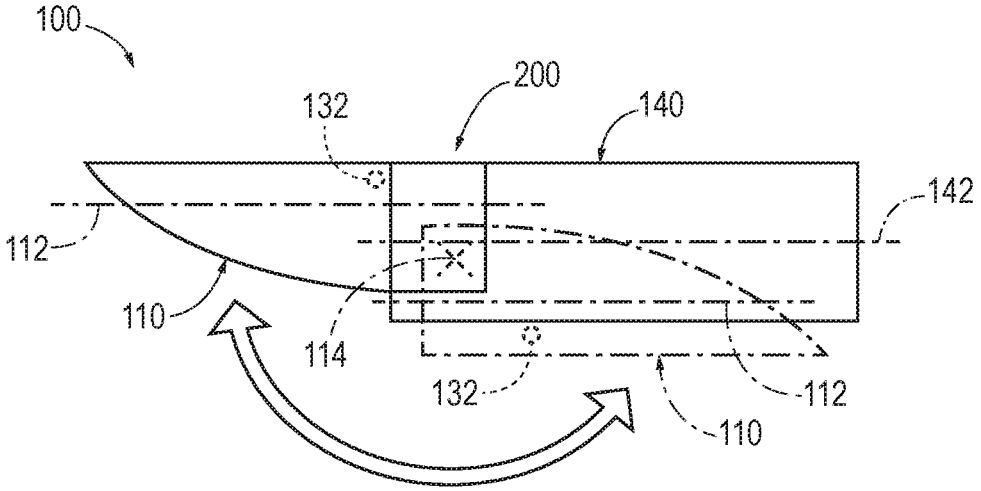
FIG. 2 is a schematic top plan view illustrating an example of a switchblade with a blade in a folded position and in a deployed position according to the present disclosure.
Figure 3:
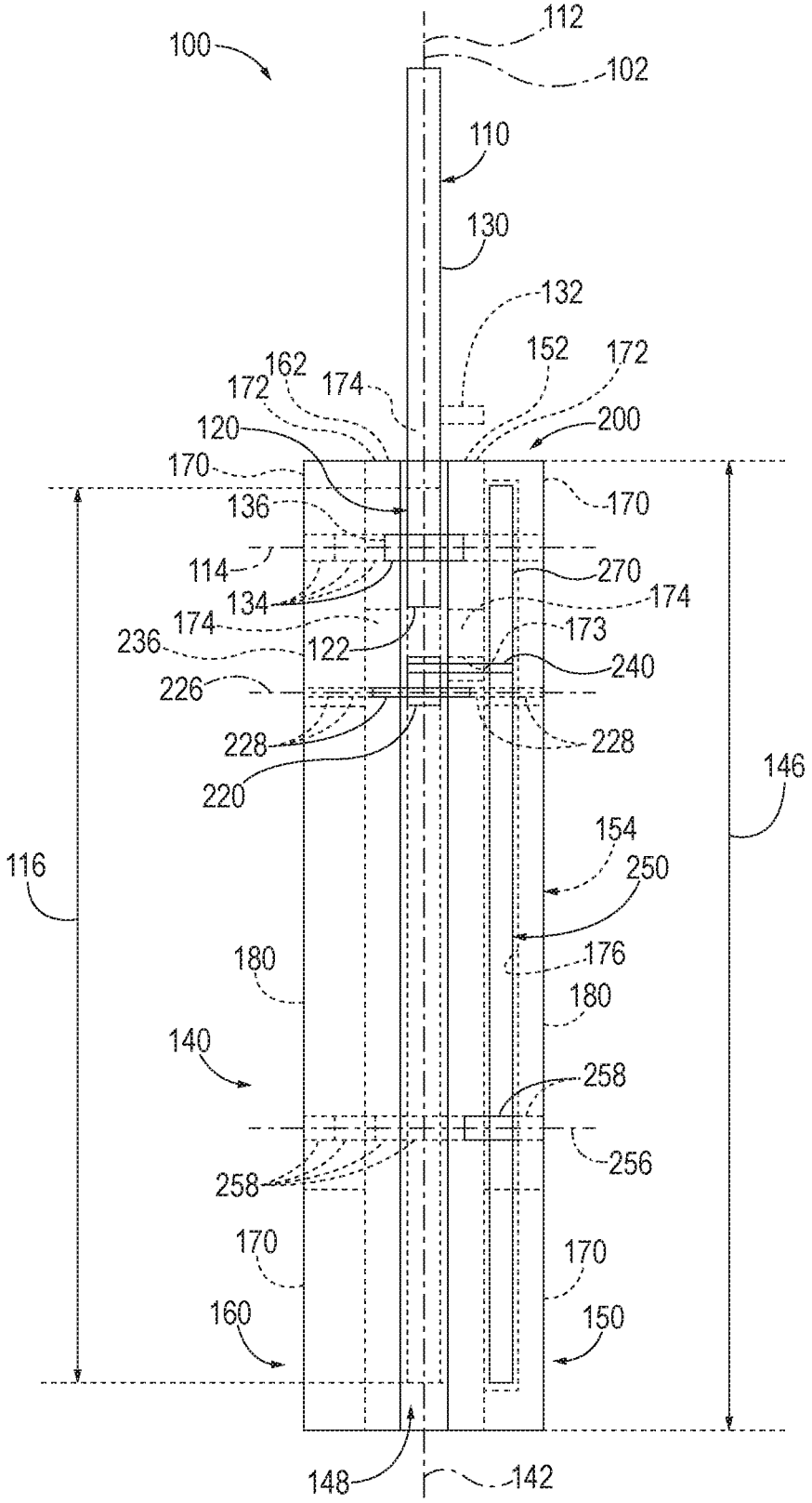
FIG. 3 is a schematic side view illustrating examples of switchblades with a blade in a folded position and in a deployed position according to the present disclosure.

FIGS. 1-3 are schematic illustrations of examples of switchblades 100. As used herein, the term "switchblade" is intended to refer to any appropriate knife that includes a blade that is selectively released (e.g., extended and/or deployed) from a body via a mechanism that releases stored potential energy to expose the blade. For the purposes of the present disclosure, such knives additionally or alternatively may be referred to as automatic knives.

As schematically illustrated in FIGS. 1 and 3, a switchblade 100 includes a handle body 140 with a first body portion 150 and a second body portion 160. As further schematically illustrated in FIG. 1, handle body 140 additionally may include a backspacer 190 that extends between first body portion 150 and second body portion 160 to maintain first body portion 150 and second body portion 160 in a spaced-apart orientation with respect to one another. Each of first body portion 150 and second body portion 160 partially defines a blade receiver region 148 between first body portion 150 and second body portion 160. In an example of switchblade 100 that includes backspacer 190, the backspacer additionally may partially define blade receiver region 148.

As further schematically illustrated in FIGS. 1-3, switchblade 100 additionally includes a blade 110 with a cutting edge 130 pivotally coupled to handle body 140. More specifically, blade 110 is configured to pivot relative to handle body 140 about a blade pivot axis 114 to transition the blade between a folded position (illustrated in dash-dot lines in FIGS. 2-3) and a deployed position (illustrated in solid lines in FIGS. 2-3). In this manner, switchblade 100 additionally or alternatively may be referred to as a folding switchblade 100. As schematically illustrated in FIGS. 2-3, cutting edge 130 is at least substantially received within blade receiver region 148 when blade 110 is in the folded position (schematically illustrated in dash-dot lines in FIGS. 2-3), and cutting edge 130 is exposed and blade 110 substantially extends from handle body 140 when blade 110 is in the deployed position (schematically illustrated in solid lines in FIGS. 2-3). In this manner, and as best schematically illustrated in FIG. 2, the folded position and the deployed position each may refer to configurations of switchblade 100 in which blade 110 and handle body 140 are at least substantially aligned (e.g., parallel). For example, and as schematically illustrated in FIGS. 2-3, blade 110 may have a blade longitudinal axis 112 and handle body 140 may have a handle longitudinal axis 142 such that blade longitudinal axis 112 and handle longitudinal axis 142 are at least substantially parallel when blade 110 is in the folded position and/or in the deployed position. As further schematically illustrated in FIGS. 1-3, blade 110 extends at least substantially within a blade plane 102 (schematically illustrated in FIGS. 1 and 3) that is at least substantially perpendicular to blade pivot axis 114 as blade 110 transitions between the folded position and the deployed position.

While the present disclosure generally relates to examples of switchblade 100 in which blade 110 and handle body 140 each extend at least substantially along respective longitudinal axes and at least substantially parallel to blade plane 102, this is not required of all examples of switchblade 100. As examples, it is additionally within the scope of the present disclosure that blade 110 and/or handle body 140 may be at least partially curved and/or may extend at least partially away from blade plane 102.

As further schematically illustrated in FIGS. 1-3, switchblade 100 additionally includes a release mechanism 200 for selectively transitioning blade 110 from the folded position to the deployed position. As discussed in more detail herein, release mechanism 200 may be selectively utilized and/or actuated to transition blade 110 to the deployed position in any appropriate manner, such as by translating and/or pivoting first body portion 150, or a portion thereof, relative to second body portion 160. Thus, release mechanism 200 also may be referred to as an automatic release mechanism that deploys blade 110 responsive to a user input but without the user manually transitioning the blade from the folded position to the deployed position. However, it is additionally within the scope of the present disclosure that blade 110 also may be configured to be manually transitioned from the folded position to the deployed position. For example, and as schematically illustrated in FIGS. 1-3, switchblade 100 additionally may include a thumb stud 132 operatively coupled to blade 110 to facilitate manually transitioning the blade from the folded position to the deployed position. In such an embodiment, thumb stud 132 may extend away from blade plane 102. In such examples, switchblade 100 additionally or alternatively may be described as a dual-action switchblade.

With continued reference to FIGS. 1 and 3, handle body 140 may have any appropriate form. As an example, handle body 140 may be a monolithic handle body that includes first body portion 150 and second body portion 160. Stated differently, in such an example, first body portion 150 and second body portion 160 may refer to respective portions and/or regions of a monolithic handle body 140. Alternatively, first body portion 150 and second body portion 160 may be distinct components that are operatively coupled to one another to at least partially form handle body 140.

Each of first body portion 150 and second body portion 160 may have any appropriate structure. For example, and as schematically illustrated in FIGS. 1 and 3, each of first body portion 150 and/or second body portion 160 may include at least one bolster 170 configured to reinforce handle body 140. In such examples, bolster 170 may be configured and/or positioned to be gripped by a user. Additionally or alternatively, and as further schematically illustrated in FIGS. 1 and 3, each of first body portion 150 and/or second body portion 160 may include at least one scale 180 configured to be gripped by a user. As an example, scale 180 may be a decorative scale. In an example of handle body 140 in which first body portion 150 and/or second body portion 160 includes at least one bolster 170 as well as at least one scale 180, such bolster(s) 170 and scale(s) 180 may have any appropriate configuration and/or orientation relative to one another. As an example, and as schematically illustrated in FIGS. 1 and 3, each of first body portion 150 and/or second body portion 160 may include scale 180 positioned between two bolsters 170. In such examples, scale 180 may be fixedly coupled to each bolster 170. Additionally or alternatively, each bolster 170 and scale 180 may be fixedly coupled to at least one other component of handle body 140 such that scale 180 is not configured to move relative to each bolster 170.

As further schematically illustrated in FIGS. 1 and 3, each of first body portion 150 and/or second body portion 160 also may include a liner 172 that at least partially defines blade receiver region 148. As a more specific example, first body portion 150 may include a first liner 152 and second body portion 160 may include a second liner 162 such that first liner 152 and second liner 162 are positioned on opposite sides of cutting edge 130 of blade 110 when the blade is in the folded position.

Blade 110 may be operatively coupled to handle body 140 in any appropriate manner. As an example, and as schematically illustrated in FIG. 3, switchblade 100 may include a blade pivot pin 134 that extends through blade 110 along blade pivot axis 114 and that operatively couples the blade to handle body 140. Stated differently, blade pivot pin 134 may be configured to restrict blade 110 from being entirely removed from handle body 140. As a more specific example, and as schematically illustrated in FIG. 3, blade 110 may include a tang 120 that extends within handle body 140 when the blade is in the deployed position, and blade pivot pin 134 may extend through the tang. Blade pivot pin 134 may be operatively coupled to handle body 140 in any appropriate manner. For example, blade pivot pin 134 may be directly coupled to first body portion 150 and/or second body portion 160. Additionally or alternatively, and as schematically illustrated in FIG. 3, blade pivot pin 134 may extend at least partially, and optionally fully, into first body portion 150 and/or second body portion 160. In some examples, blade pivot pin 134 is positioned within handle body 140 such that the blade pivot pin is concealed from view from exterior switchblade 100. Blade pivot pin 134 may include, be, and/or be operatively coupled to handle body 140 via any appropriate structure, such as a caged bearing, a bushing, a screw, a shoulder screw, and/or a pin.

Figure 4:
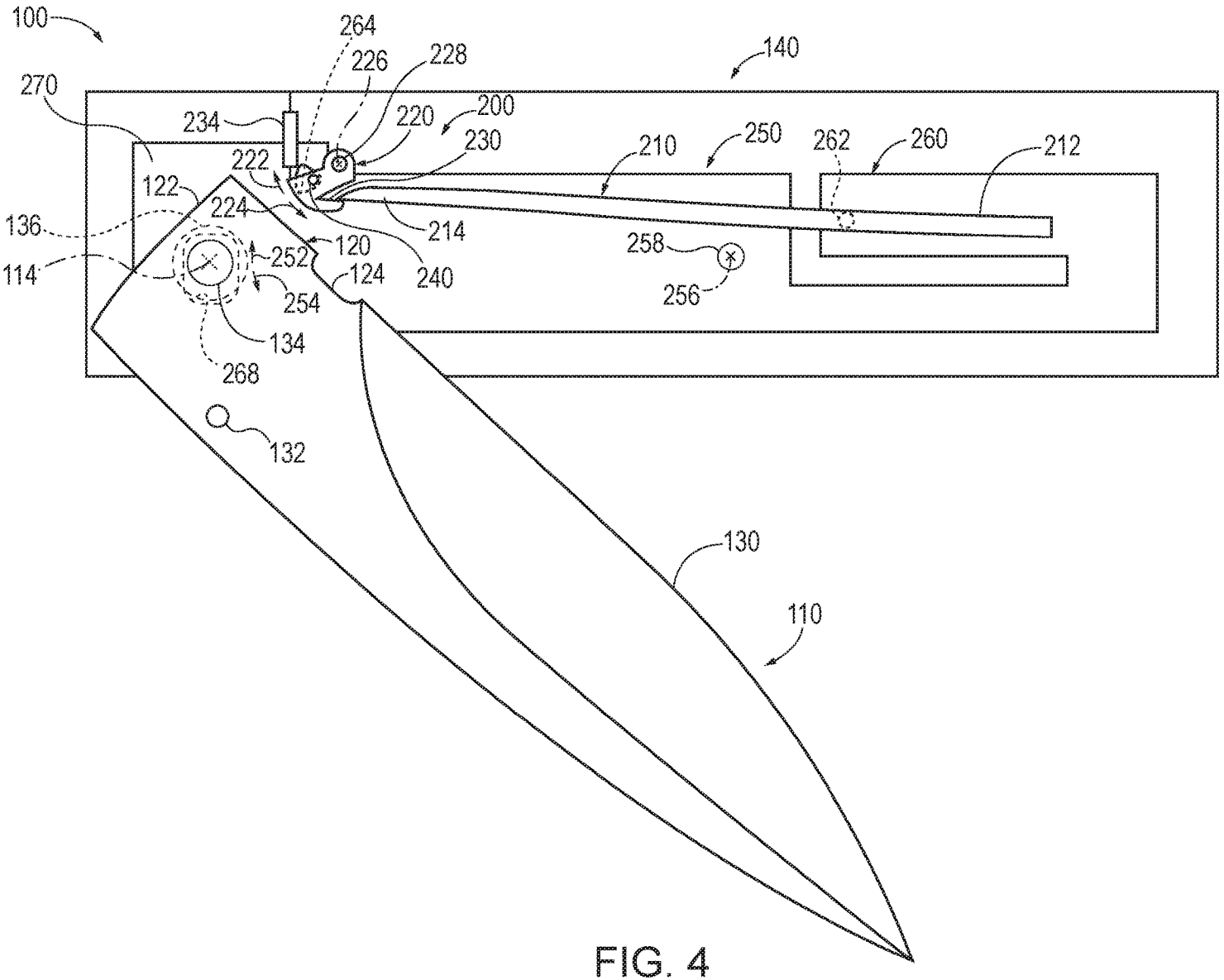
FIG. 4 is a schematic top plan view illustrating examples of a portion of a switchblade with a sear in a retaining position and with a return spring in a retained configuration according to the present disclosure.
Figure 5:
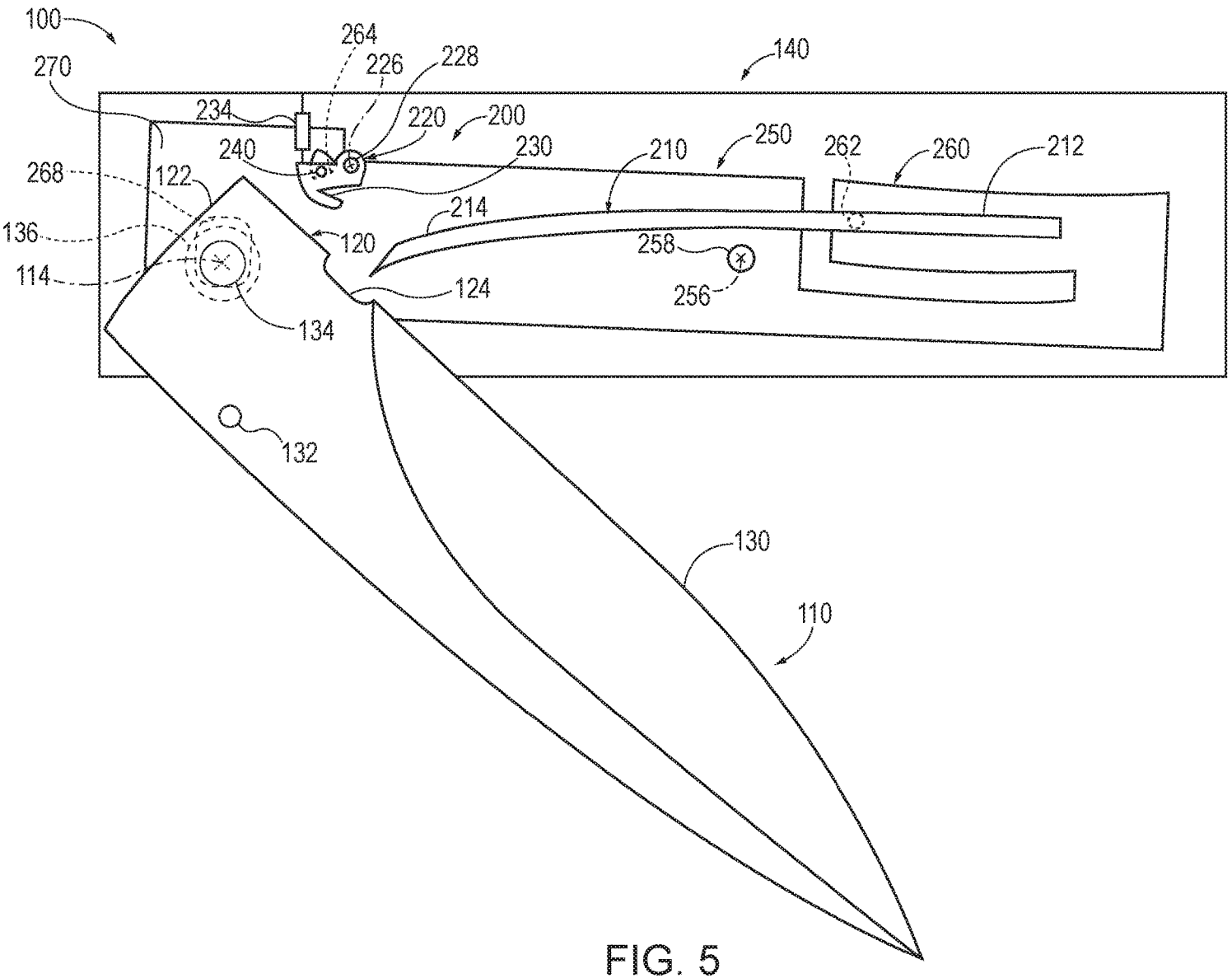
FIG. 5 is a schematic top plan view illustrating the portion of the switchblade of FIG. 4 with the sear in the releasing position and with the return spring in a released configuration according to the present disclosure.
Figure 6:
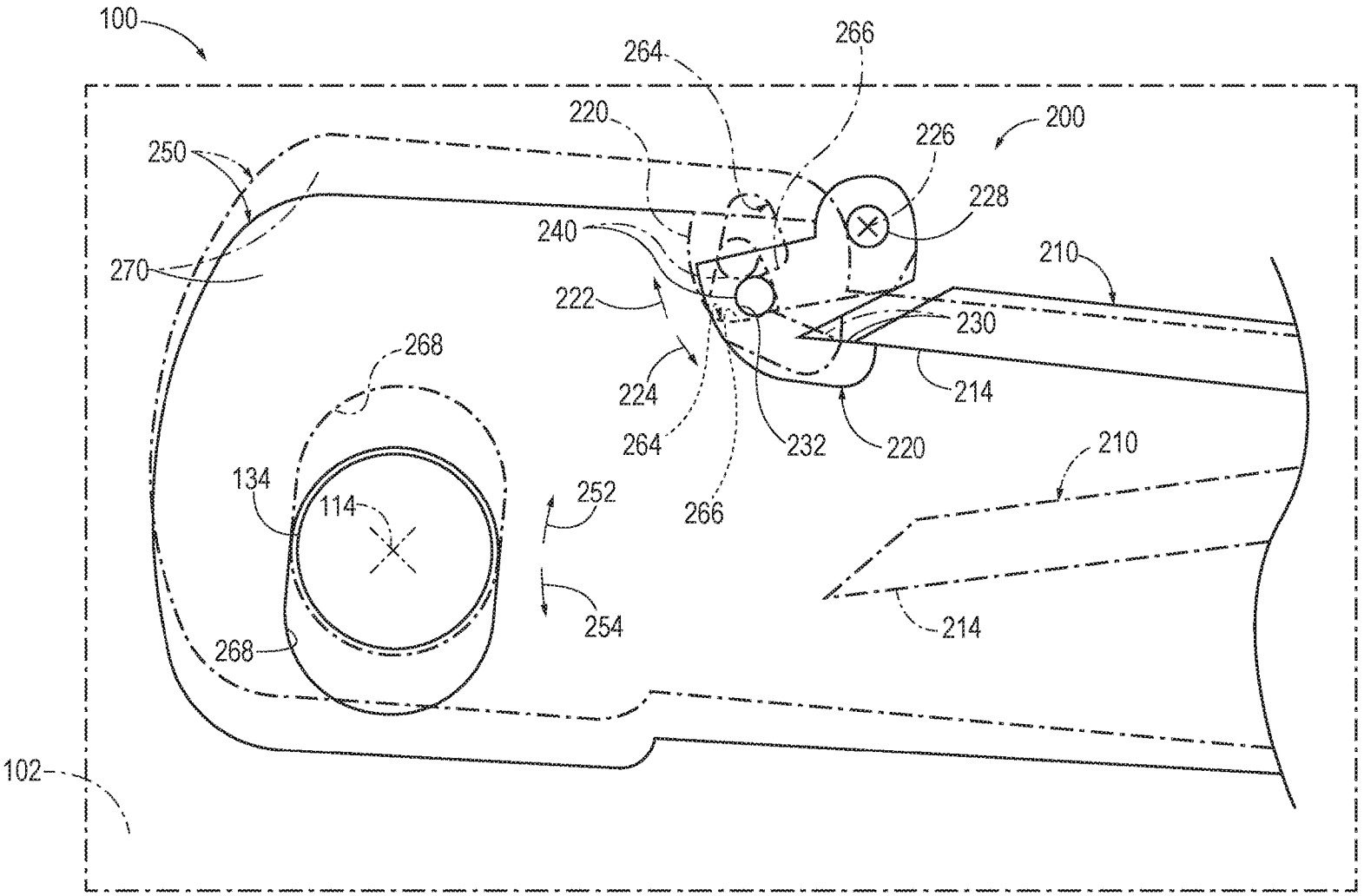
FIG. 6 is a fragmentary top plan view illustrating an example of a portion of a release mechanism of a switchblade according to the present disclosure.

FIGS. 4-5 schematically illustrate components of release mechanism 200, while FIG. 6 is a less schematic illustration of components of release mechanism 200. As schematically illustrated in FIGS. 4-5 and less schematically illustrated in FIG. 6, release mechanism 200 includes a release spring 210 configured to drive blade 110 from the folded position to the deployed position upon actuation of release mechanism 200, as described herein. Release spring 210 is configured to be selectively transitioned between a retained configuration (illustrated in FIG. 4 and in solid lines in FIG. 6) and a released configuration (illustrated in FIG. 5 and in dash-dot lines in FIG. 6), and is biased toward the released configuration while in the retained configuration. Stated differently, release spring 210 stores a greater spring potential energy while in the retained configuration than while in the released configuration such that transitioning the release spring from the retained configuration to the released configuration corresponds to converting the stored spring potential energy into kinetic energy to drive the release spring from the retained configuration to the released configuration. In this manner, when blade 110 is in the folded position, transitioning release spring 210 from the retained configuration to the released configuration corresponds to the release spring moving toward the blade (e.g., in a direction that establishes and/or maintains contact between the release spring and the blade), thereby pushing the blade out of blade receiver region 148 and toward the deployed position. As additionally schematically illustrated in FIGS. 4-5 and less schematically illustrated in FIG. 6, release mechanism 200 further includes a sear 220 configured to selectively retain release spring 210 in the retained configuration. Sear 220 is configured to pivot relative to handle body 140 about a sear pivot axis 226 that is at least substantially parallel to blade pivot axis 114 to selectively transition between a retaining position of the sear (illustrated in FIG. 4 and in solid lines in FIG. 6) and a releasing position of the sear (illustrated in FIG. 5 and in dash-dot lines in FIG. 6). As schematically illustrated in FIGS. 4 and 6, sear 220 is in the retaining position when release spring 210 is in the retained configuration. Stated differently, release spring 210 is retained in the retained configuration by sear 220 only when sear 220 is in the retaining position. In this manner, sear 220 may be described as being in the retaining position when sear 220 assumes any rotational orientation relative to handle body 140 in which release spring 210 may be retained in the retained configuration via engagement with the sear. Similarly, sear 220 may be described as being in the releasing position when sear 220 assumes any rotational orientation relative to handle body 140 in which the sear does not restrict release spring 210 from transitioning from the retained configuration to the released configuration. In this manner, as used herein, the terms "retaining position" and "releasing position" each may refer to and/or encompass a respective plurality and/or range of positions and/or rotational orientations.

As discussed in more detail herein, release mechanism 200 is configured to enable release spring 210 to transition from the retained configuration to the released configuration responsive to sear 220 transitioning from the retaining position to the releasing position. Stated differently, transitioning sear 220 from the retaining position to the releasing position corresponds to releasing release spring 210 from the retained configuration, thereby permitting the release spring to transition to the released configuration to drive blade 110 from the folded position to the deployed position. Thus, when release spring 210 is in the retained configuration and when blade 110 is in the folded position, selectively transitioning sear 220 from the retaining position to the releasing position operates to transition the blade from the folded position to the deployed position via the potential energy previously stored in release spring 210. In some examples, and as schematically illustrated in FIGS. 1 and 3, release mechanism 200 additionally includes a sear safety mechanism 236 configured to selectively restrict sear 220 from being transitioned from the retaining position to the releasing position. Sear safety mechanism 236 thus may restrict blade 110 from being inadvertently deployed from handle body 140 when the sear safety mechanism is selectively activated. Sear safety mechanism 236 may include and/or be any appropriate mechanism and/or structure, such as a mechanism that restricts sear 220 from pivoting away from the retaining position.

Sear 220 may be operatively coupled to handle body 140 in any appropriate manner. As an example, and as schematically illustrated in FIG. 3, sear 220 may be positioned between first liner 152 and second liner 162 of handle body 140. Additionally or alternatively, and as further schematically illustrated in FIG. 3, switchblade 100 may include a sear pivot pin 228 that extends through sear 220 along sear pivot axis 226 and that operatively couples the sear to handle body 140. More specifically, sear pivot pin 228 may be directly coupled to and/or engaged with first body portion 150 and/or second body portion 160. For example, sear pivot pin 228 may extend at least partially into each of first body portion 150 and second body portion 160 such that the sear pivot pin supports sear 220 within blade receiver region 148. Additionally or alternatively, and as schematically illustrated in FIG. 3, sear pivot pin 228 may extend at least partially, and optionally fully, into first body portion 150 and/or second body portion 160. Sear pivot pin 228 may be positioned within handle body 140 such that the sear pivot pin is concealed from view from exterior switchblade 100. As further schematically illustrated in FIGS. 1 and 3-5, blade 110 and/or tang 120 may define a sear recess 124 that at least partially receives sear 220 when blade 110 is in the folded position.

Release spring 210 may have any appropriate form and may be operatively coupled to handle body 140 and/or release mechanism 200 in any appropriate manner. As examples, release spring 210 may include and/or be a flat spring, a cantilever spring, and/or a leaf spring. As a more specific example, and as schematically illustrated in FIGS. 4-5, release spring 210 may include a fixed end 212 that is fixedly coupled to handle body 140 and an action end 214 that engages blade 110 to transition the blade from the folded position to the deployed position. In such an example, and as schematically illustrated in FIGS. 4-5 and less schematically illustrated in FIG. 6, sear 220 may be described as including a spring catch 230 configured to engage action end 214 when release spring 210 is in the retained configuration. Stated differently, when release spring 210 is in the retained configuration, engagement between action end 214 and spring catch 230 may restrict release spring 210 from transitioning from the retained configuration to the released configuration. In some examples, when release spring 210 is in the retained configuration, action end 214 may exert a force on spring catch 230 that is directed such that action end 214 biases sear 220 toward second sear pivot direction 224. Thus, in such examples, engagement between release spring 210 and sear 220 biases the sear so as to restrict blade 110 from being unintentionally transitioned to the deployed position by unintentionally pivoting the sear in first sear pivot direction 222.

As further schematically illustrated in FIGS. 4-5 and less schematically illustrated in FIG. 6, release mechanism 200 additionally includes an actuator 250 configured to transition sear 220 from the retaining position to the releasing position. Specifically, and as schematically illustrated in FIGS. 4-5, actuator 250 includes an actuator arm 270 that is configured to move relative to at least a portion of handle body 140 to selectively transition the actuator between a nominal configuration of the actuator and an actuated configuration of the actuator. For example, actuator arm 270 may be configured to pivot and/or translate relative to at least a portion of handle body 140 as actuator 250 transitions between the nominal configuration and the actuated configuration. As a more specific example, illustrated in FIGS. 4-5, actuator arm 270 may be configured to pivot relative to handle body 140 about an actuator pivot axis 256 to selectively transition the actuator between the nominal configuration (illustrated in FIG. 4) and the actuated configuration (illustrated in FIG. 5). FIG. 6 additionally illustrates actuator 250 in the nominal configuration in solid lines and in the actuated configuration in dash-dot lines. As illustrated in FIG. 4 and in solid lines in FIG. 6, actuator 250 is in the nominal configuration when sear 220 is in the retaining position. As illustrated in FIG. 5 and in dash-dot lines in FIG. 6, sear 220 is in the releasing position when actuator 250 is in the actuated configuration. More specifically, and as discussed in more detail herein, release mechanism 200 is configured to transition sear 220 from the retaining position to the releasing position responsive to actuator arm 270 moving relative to handle body 140 (such as by pivoting about actuator pivot axis 256) to transition actuator 250 from the nominal configuration to the actuated configuration. Stated differently, when sear 220 is in the retaining position, when release spring 210 is in the retained configuration, and when blade 110 is in the folded position, selectively transitioning actuator 250 from the nominal configuration to the actuated configuration operates to transition sear 220 from the retaining position to the releasing position, thereby releasing release spring 210 to transition from the retained configuration to the released configuration and transitioning the blade from the folded position to the deployed position.

While the present disclosure generally describes examples in which actuator arm 270 pivots relative to handle body 140 as actuator 250 transitions between the nominal configuration and the actuated configuration, this is not required of all examples of release mechanism 200. For example, it is additionally within the scope of the present disclosure that actuator arm 270 may primarily and/or substantially translate relative to handle body 140, such as along a direction at least substantially parallel to blade plane 102, as actuator 250 transitions between the nominal configuration and the actuated configuration.

Actuator 250 may have any appropriate structure for transitioning between the nominal configuration and the actuated configuration and/or for transitioning sear 220 between the retaining position and the releasing position. As an example, and as schematically illustrated in FIGS. 4-5 and less schematically illustrated in FIG. 6, actuator 250 may include and/or be an actuator plate that extends at least substantially parallel to blade plane 102 (illustrated in FIG. 6). In this manner, actuator 250 may be incorporated into and/or concealed by at least a portion of handle body 140 in an unobtrusive manner.

Actuator 250 may be configured to be selectively actuated to pivot and/or translate actuator arm 270 in any appropriate manner. As an example, and as schematically illustrated in FIGS. 1 and 3, first body portion 150 of handle body 140 may include an actuator grip 154 that is fixedly coupled to actuator 250 and that is configured to be manually pivoted about actuator pivot axis 256 and/or manually translated by a user to transition the actuator from the nominal configuration to the actuated configuration. As a more specific example, actuator grip 154 may be configured to pivot and/or translate relative to another component of first body portion 150, such as first liner 152, as actuator 250 transitions between the nominal configuration and the actuated configuration. In such examples, actuator grip 154 may include and/or be any appropriate portion of first body portion 150. As examples, actuator grip 154 may include and/or be at least one bolster 170 and/or at least one scale 180 of first body portion 150. As a more specific example, and as schematically illustrated in FIGS. 1 and 3, actuator grip 154 may include one scale 180 positioned between two bolsters 170.

As discussed, FIGS. 4-6 collectively illustrate functional relationships between release spring 210, sear 220, and actuator 250, with these relationships perhaps most clearly illustrated in FIG. 6. As illustrated in FIGS. 4 and 6, sear 220 may be configured to pivot about sear pivot axis 226 relative to handle body 140 in a first sear pivot direction 222 as the sear transitions from the retaining position (solid lines in FIG. 6) to the releasing position (dash-dot lines in FIG. 6), and to pivot about the sear pivot axis in a second sear pivot direction 224 that is opposite first sear pivot direction 222 as the sear transitions from the releasing position to the retaining position. As additionally illustrated in FIGS. 4 and 6, first sear pivot direction 222 and second sear pivot direction 224 generally refer to rotational directions, such that a point traveling along first sear pivot direction 222 or along second sear pivot direction 224 travels along an arcuate path.

As additionally illustrated in FIGS. 4 and 6, actuator arm 270 may be configured to pivot relative to handle body 140 about actuator pivot axis 256 (illustrated in FIG. 4) in a first actuator pivot direction 252 as actuator 250 transitions from the nominal configuration (solid lines in FIG. 6) to the actuated configuration (dash-dot lines in FIG. 6), and to pivot about the actuator pivot axis in a second actuator pivot direction 254 that is opposite first actuator pivot direction 252 as the actuator transitions from the actuated configuration to the nominal configuration. As additionally illustrated in FIGS. 4 and 6, first actuator pivot direction 252 and second actuator pivot direction 254 generally refer to rotational directions, such that a point traveling along first actuator pivot direction 252 or along second actuator pivot direction 254 travels along an arcuate path. As further illustrated in FIGS. 4 and 6, first sear pivot direction 222 may be oblique to first actuator pivot direction 252. Stated differently, first sear pivot direction 222 may be neither parallel to nor perpendicular to first actuator pivot direction 252 at any point within a pivotal range of motion of sear 220 and/or of actuator arm 270.

As discussed, selectively actuating actuator 250 operates to transition sear 220 from the retaining position to the releasing position by pivoting sear 220 about sear pivot axis 226. The actuation of actuator 250 may cause sear 220 to pivot relative to handle body 140 about sear pivot axis 226 in any appropriate manner. For example, and as illustrated in FIGS. 4-6, release mechanism 200 may include a sear drive pin 240 that operates to pivot sear 220 about sear pivot axis 226 responsive to actuator 250 transitioning from the nominal configuration to the actuated configuration. As illustrated in FIG. 6, sear 220 may define a sear drive pin receiver 232 that at least partially receives sear drive pin 240. Alternatively, sear 220 may include and/or define sear drive pin 240. As examples, sear 220 and sear drive pin 240 may be monolithic, coextensive, and/or integrally formed. Actuator 250 may operatively engage sear drive pin 240 in any appropriate manner. For example, and as best illustrated in FIG. 6, actuator 250 and/or actuator arm 270 may define a sear drive pin engagement surface 266 that engages sear drive pin 240 as actuator 250 transitions from the nominal configuration to the actuated configuration. In such examples, and as described in more detail below, transitioning actuator 250 from the nominal configuration to the actuated configuration operates to urge sear drive pin engagement surface 266 toward sear drive pin 240, thus pivoting sear 220 about sear pivot axis 226. In some examples of actuator 250, and as illustrated in FIG. 6, actuator 250 defines a sear drive pin slot 264 that at least partially circumferentially encloses at least a portion of sear drive pin 240, such that sear drive pin engagement surface 266 partially defines the sear drive pin slot. Stated differently, in such an example, sear drive pin 240 may extend at least partially through sear drive pin slot 264.

Sear drive pin 240 may be at least substantially restricted from translating with respect to sear drive pin receiver 232 in a direction parallel to blade plane 102. Stated differently, sear drive pin receiver 232 may be sized to receive sear drive pin 240 in a close fit arrangement. Accordingly, in such an example, sear drive pin 240 may be at least substantially constrained to travel along first sear pivot direction 222 when sear 220 pivots in the first sear pivot direction and to translate along second sear pivot direction 224 when the sear pivots in the second sear pivot direction. In this manner, such a configuration may facilitate selectively pivoting sear 220 between the retaining position and the releasing position by selectively positioning sear drive pin 240 relative to handle body 140.

Sear drive pin 240 may be configured to transition sear 220 from the retaining position to the releasing position responsive to sear drive pin 240 urging the sear in first sear pivot direction 222. Stated differently, sear drive pin 240 may operatively couple actuator 250 to sear 220 such that transitioning actuator 250 from the nominal configuration to the actuated configuration operates to urge sear drive pin 240 (and hence sear 220) in first sear pivot direction 222, thereby transitioning the sear from the retaining position to the releasing position. Sear drive pin engagement surface 266 may have any appropriate shape and/or structure for urging sear drive pin 240 in first sear pivot direction 222. For example, actuator 250 and/or sear drive pin engagement surface 266 may be configured such that sear drive pin 240 translates along sear drive pin engagement surface 266 in a direction at least substantially parallel to blade plane 102 as actuator 250 urges sear drive pin 240 in first sear pivot direction 222. As a more specific example, FIG. 6 illustrates an example in which actuator arm 270 pivots about actuator pivot axis 256 in first actuator pivot direction 252 as actuator 250 transitions from the nominal configuration to the actuated configuration. In the example of FIG. 6, because first actuator pivot direction 252 is not parallel to first sear pivot direction 222, and because sear drive pin 240 is constrained to travel along first sear pivot direction 222 as sear 220 pivots in the first sear pivot direction, a position of the sear drive pin relative to sear drive pin engagement surface 266 shifts as the sear drive pin engagement surface travels along the first actuator pivot direction.

As another example, and as discussed, actuator 250 may be configured such that actuator arm 270 translates along a first actuator translation direction as actuator 250 transitions from the nominal configuration to the actuated configuration. In such an example, sear drive pin engagement surface 266 may be oblique to the first actuator translation direction such that a normal force exerted upon sear drive pin 240 by sear drive pin engagement surface 266 has a component that is parallel to first sear pivot direction 222. Stated differently, in such an example, sear drive pin engagement surface 266 may be angled relative to the first actuator translation direction such that translating actuator arm 270 along the first actuator translation direction operates to push sear drive pin 240 to travel along first sear pivot direction 222.

Subsequent to sear 220 transitioning from the retaining position to the releasing position, such as to transition release spring 210 to the released configuration, release mechanism 200 may be configured to transition sear 220 from the releasing position to the retaining position in any appropriate manner. As an example, in an embodiment in which sear drive pin engagement surface 266 at least partially defines sear drive pin slot 264, sear 220 may be configured to transition from the releasing position to the retaining position at least partially responsive to the sear drive pin slot urging sear drive pin 240 in second sear pivot direction 224, such as while actuator 250 transitions from the actuated configuration to the nominal configuration. Additionally or alternatively, and as schematically illustrated in FIGS. 4-5, release mechanism 200 additionally may include a sear return spring 234 that biases sear 220 in second sear pivot direction 224. In such an example, sear 220 is configured to transition from the releasing position to the retaining position at least partially responsive to sear return spring 234 urging sear 220 in second sear pivot direction 224. Stated differently, in such an example, sear 220 may be configured to automatically return to and/or remain in the retaining position unless urged out of the retaining position by sear drive pin 240.

Release mechanism 200 further may be configured such that release spring 210 may be transitioned from the released configuration to the retained configuration without transitioning actuator 250 from the nominal configuration to the actuated configuration. Stated differently, release mechanism 200 may be configured such that actuator 250 may remain in the nominal configuration while release spring 210 is transitioned form the released configuration to the retained configuration. For example, when switchblade 100 is in an unfolded state in which blade 110 is in the deployed position, release spring 210 is in the released configuration, sear 220 is in the retaining position, and actuator 250 is in the nominal configuration, it may be desirable to transition the blade from the deployed position to the folded position without concurrently or consequently transitioning the actuator from the nominal configuration to the actuated configuration. As may be seen with reference to FIGS. 4-6, transitioning blade 110 (illustrated in FIGS. 4-5) from the deployed position to the folded position may include pivoting release spring 210 toward sear 220 via engagement between the blade and the release spring. For example, transitioning blade 110 from the deployed position to the folded position may include a user manually urging the blade toward and into blade receiver region 148 of handle body 140. When release spring 210 reaches sear 220, engagement between the release spring and the sear may urge the sear to pivot in first sear pivot direction 222 to transition the sear from the retaining position (solid lines in FIG. 6) to the releasing position (dash-dot lines in FIG. 6). Once release spring 210 reaches the retained configuration, sear 220 may be free to pivot in second sear pivot direction 224 (such as responsive to a bias of sear return spring 234, schematically illustrated in FIGS. 4-5) such that the sear returns to the retaining position. When the user subsequently ceases urging blade 110 toward and into blade receiver region 148, action end 214 of release spring 210 may engage spring catch 230 of sear 220 to retain the release spring in the retained configuration.

As discussed, transitioning release spring 210 from the released configuration to the retained configuration generally includes transitioning sear 220 at least from the releasing position to the retaining position. Accordingly, transitioning the release spring to the retained configuration while actuator 250 remains in the nominal configuration generally requires that sear drive pin 240 be able to move relative to actuator 250 and at least partially independent of sear drive pin engagement surface 266. Thus, in an example of actuator 250 that includes sear drive pin slot 264, the sear drive pin slot may be sized and/or shaped to permit sear drive pin 240 to move along first sear pivot direction 222 as sear 220 transitions from the retaining position to the releasing position while actuator 250 remains in the nominal configuration. Similarly, the sear drive pin slot may be sized and/or shaped to permit sear drive pin 240 to move along second sear pivot direction 224 as sear 220 transitions from the releasing position to the retaining position while actuator 250 remains in the nominal configuration. As an example of such a configuration, and as illustrated in FIG. 6, sear drive pin slot 264 may have a linear dimension, as measured along a direction at least substantially parallel to first sear pivot direction 222, that is greater than a diameter of sear drive pin 240. Stated differently, actuator arm 270 and/or sear drive pin slot 264 may be configured such that actuator arm 270 does not restrict sear drive pin 240 from moving relative to actuator arm 270 as sear 220 transitions between the retaining position and the releasing position and while actuator 250 remains in the nominal configuration. As a more specific example, and as additionally illustrated in FIG. 6, sear drive pin slot 264 may be at least substantially triangular (e.g., with three linear sides connected by three rounded corners, with one of the linear sides corresponding to sear drive pin engagement surface 266). In such an example, sear drive pin 240 may be configured to move along first sear pivot direction 222 with respect to sear drive pin slot 264, such as to permit sear 220 to pivot in the first sear pivot direction while actuator 250 remains in the nominal configuration. More specifically, and with reference to FIG. 6, such a configuration may permit sear 220 to transition to the releasing position (illustrated in dash-dot lines in FIG. 6) while sear drive pin slot 264 remains in the orientation illustrated in dashed lines in FIG. 6. Thus, such a configuration may permit sear 220 to transition from the retaining position to the releasing position (such as responsive to engagement with release spring 210) and/or from the releasing position to the retaining position (such as responsive to release spring 210 reaching the retained configuration) without actuator arm 270 moving relative to handle body 140.

Actuator 250 may be operatively coupled to handle body 140 in any appropriate manner. As an example, and as schematically illustrated in FIG. 3, sear 220 and actuator 250 may be positioned on opposite sides of first liner 152. Additionally or alternatively, and as schematically illustrated in FIG. 3, switchblade 100 may include an actuator fastener 258 that extends at least partially through actuator 250 along actuator pivot axis 256 and that operatively couples the actuator to handle body 140. As more specific examples, actuator fastener 258 may be directly coupled to first body portion 150 and/or second body portion 160. Additionally or alternatively, and as schematically illustrated in FIG. 3, actuator fastener 258 may extend at least partially, and optionally fully, into first body portion 150, second body portion 160, and/or actuator grip 154. Actuator fastener 258 may be positioned within handle body 140 such that the actuator fastener is concealed from view from exterior switchblade 100. As further schematically illustrated in FIG. 3, first body portion 150 and/or actuator grip 154 may define an actuator pocket 176 that at least substantially encloses actuator 250. In such an example, actuator fastener 258 may extend at least partially, and optionally fully, through actuator pocket 176. Actuator fastener 258 may include and/or be any appropriate fastener, such as a pin, a screw, and/or a shoulder screw.

Actuator 250 further may be configured such that actuator arm 270 may pivot and/or translate relative to handle body 140 without obstruction by blade pivot pin 134. For example, and as additionally schematically illustrated in FIGS. 4-5 and less schematically illustrated in FIG. 6, actuator 250 and/or actuator arm 270 may define a blade pivot pin slot 268 such that blade pivot pin 134 extends through the blade pivot pin slot. As best illustrated in FIG. 6, blade pivot pin slot 268 may be configured to move with respect to blade pivot pin 134 in a direction at least substantially parallel to blade plane 102 as actuator 250 transitions between the nominal configuration (solid lines) and the actuated configuration (dash-dot lines). Accordingly, blade pivot pin slot 268 may be sized and/or shaped such that blade pivot pin 134 remains within the blade pivot pin slot while actuator 250 transitions between the nominal configuration and the actuated configuration.

In some examples, handle body 140, release mechanism 200, and/or actuator 250 may be configured to limit an extent to which actuator arm 270 and/or sear drive pin 240 may move relative to handle body 140. As an example, and as further illustrated in FIG. 6, blade pivot pin 134 may engage a portion of a perimeter of blade pivot pin slot 268 when actuator 250 is in the nominal configuration and/or in the actuated configuration. In this manner, in an example in which actuator arm 270 pivots relative to handle body 140, blade pivot pin 134 may define a pivotal range of motion of actuator 250. As another example, and as schematically illustrated in FIG. 3, sear drive pin 240 may extend at least partially through a sear drive pin hole 173 defined in a component of handle body 140, such as liner 172 between sear 220 and actuator 250, such that sear drive pin 240 engages an edge of sear drive pin hole 173 when sear 220 is in one or both of the retaining position and the releasing position. In such examples, a dimension of sear drive pin hole 173 along a direction parallel to first sear pivot direction 222 and/or second sear pivot direction 224 may define a range of motion of sear pivot pin 228. Accordingly, the dimension of sear drive pin hole 173 may correspond to and/or define a range of motion of actuator arm 270 corresponding to releasing blade 110 from the folded position to the deployed position. In this manner, configuring sear drive pin hole 173 to have a reduced dimension may correspond to actuator 250 being actuated by a smaller motion of actuator arm 270 relative to a portion of handle body 140.

In some embodiments, and as schematically illustrated in FIGS. 3-5, switchblade 100 additionally may include a blade pivot pin retainer 136 configured to at least partially retain blade pivot pin 134 in position with respect to handle body 140. As an example, blade pivot pin retainer 136 may include and/or be a screw or other fastener that extends within blade pivot pin 134, and/or may be a component of blade pivot pin 134. In such examples, and as schematically illustrated in FIGS. 4-5, blade pivot pin retainer 136 may have a diameter that is greater than a linear dimension of blade pivot pin slot 268 such that the blade pivot pin retainer at least partially restricts actuator 250 from moving with respect to blade pivot pin 134 in a direction parallel to blade pivot axis 114.

Actuator 250 may be configured to automatically return to the nominal position subsequent to being transitioned to the actuated position. Stated differently, actuator 250 may be biased toward the nominal position while in the actuated position. More specifically, and as schematically illustrated in FIGS. 4-5, actuator 250 may include an actuator return spring 260 configured to bias the actuator toward the nominal configuration. In such an example, actuator 250 may at least partially define actuator return spring 260. For example, actuator 250 and actuator return spring 260 may be monolithic, coextensive, and/or integrally formed. Additionally or alternatively, actuator return spring 260 may refer to a region and/or portion of actuator 250. Actuator return spring 260 may include and/or be any appropriate spring, such as a flat spring, a cantilever spring, and a leaf spring. As a more specific example, and as additionally schematically illustrated in FIGS. 4-5, actuator return spring 260 may include a return spring attachment point 262 that remains at least substantially fixed relative to handle body 140 as actuator 250 transitions between the nominal configuration and the actuated configuration. In this manner, actuator return spring 260 is flexed as actuator 250 pivots about actuator pivot axis 256 to transition from the nominal configuration to the actuated configuration. Stated differently, actuator return spring 260 stores a greater spring potential energy when actuator 250 is in the actuated configuration relative to when the actuator is in the nominal configuration. As a more specific example, and as schematically illustrated in FIGS. 4-5, actuator pivot axis 256 and return spring attachment point 262 may remain fixed with respect to the portion of handle body 140 as actuator 250 pivots in first actuator pivot direction 252 with respect to a portion of handle body 140, thereby causing actuator return spring 260 to deform in such a manner that the actuator is biased in second actuator pivot direction 254. Return spring attachment point 262 may be at least substantially fixed relative to handle body 140 via any appropriate structure and/or mechanism, such as a fastener, a pin, a screw, and/or a shoulder screw.

Switchblade 100 may be configured to selectively and/or automatically retain blade 110 in the deployed position. For example, switchblade 100 may be configured such that blade 110 is automatically restricted from transitioning from the deployed position to the folded position upon reaching the deployed position. As a more specific example, and as schematically illustrated in FIGS. 1 and 3, first liner 152 and/or second liner 162 may include and/or define a lock spring 174 configured to retain blade 110 in the deployed position. When present, lock spring 174 may be configured to automatically retain blade 110 in the deployed position when the blade reaches the deployed position, and lock spring 174 may be configured to be selectively manipulated to permit the blade to transition from the deployed position to the folded position. For example, lock spring 174 may be biased toward blade plane 102 such that, when blade 110 is transitioned to the deployed position, lock spring 174 moves toward blade plane 102 to engage a butt 122 of tang 120 of the blade to retain the blade in the deployed position. In this manner, when blade 110 is in the deployed position, lock spring 174 may engage butt 122 of tang 120 such that blade 110 is restricted from transitioning away from the deployed position. In such an example, when blade 110 is in the deployed position, lock spring 174 may be configured to be manually moved away from blade plane 102 to permit the blade to transition from the deployed position to the folded position. Lock spring 174 may include and/or be any appropriate structure, such as a flat spring, a cantilever spring, and/or a leaf spring.

Switchblade 100 and/or any component thereof may have any appropriate dimensions. As examples, and as schematically illustrated in FIGS. 1 and 3, blade 110 may have a blade length 116, as measured along a direction parallel to blade longitudinal axis 112, that is of at least 5 centimeters (cm), at least 10 cm, at least 15 cm, at least 20 cm, at most 25 cm, at most 17 cm, at most 12 cm, and/or at most 7 cm. As additional examples and as further schematically illustrated in FIGS. 1 and 3, handle body 140 may have a handle body length 146, as measured along a direction parallel to handle longitudinal axis 142, that is at least 5 cm, at least 10 cm, at least 15 cm, at least 20 cm, at most 25 cm, at most 17 cm, at most 12 cm, and/or at most 7 cm.

Figure 7:
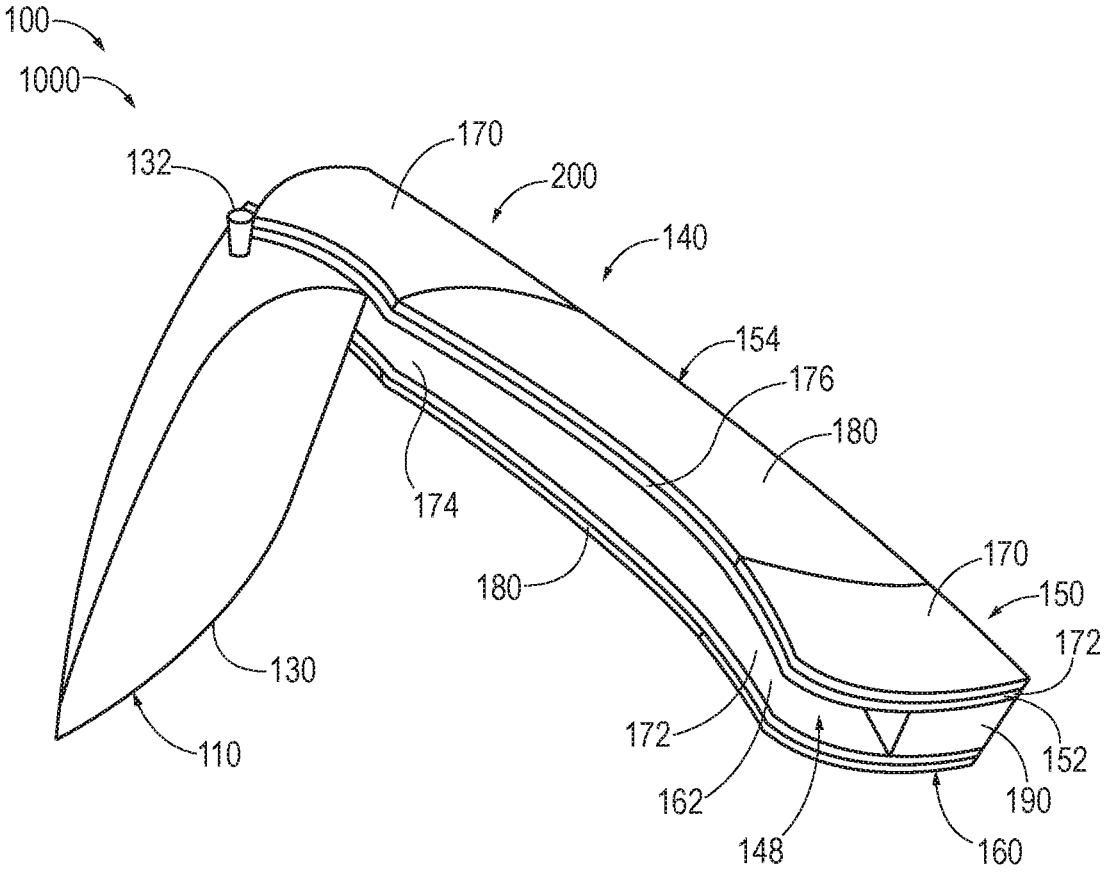
FIG. 7 is a top side isometric view illustrating an example of a switchblade according to the present disclosure.
Figure 8:
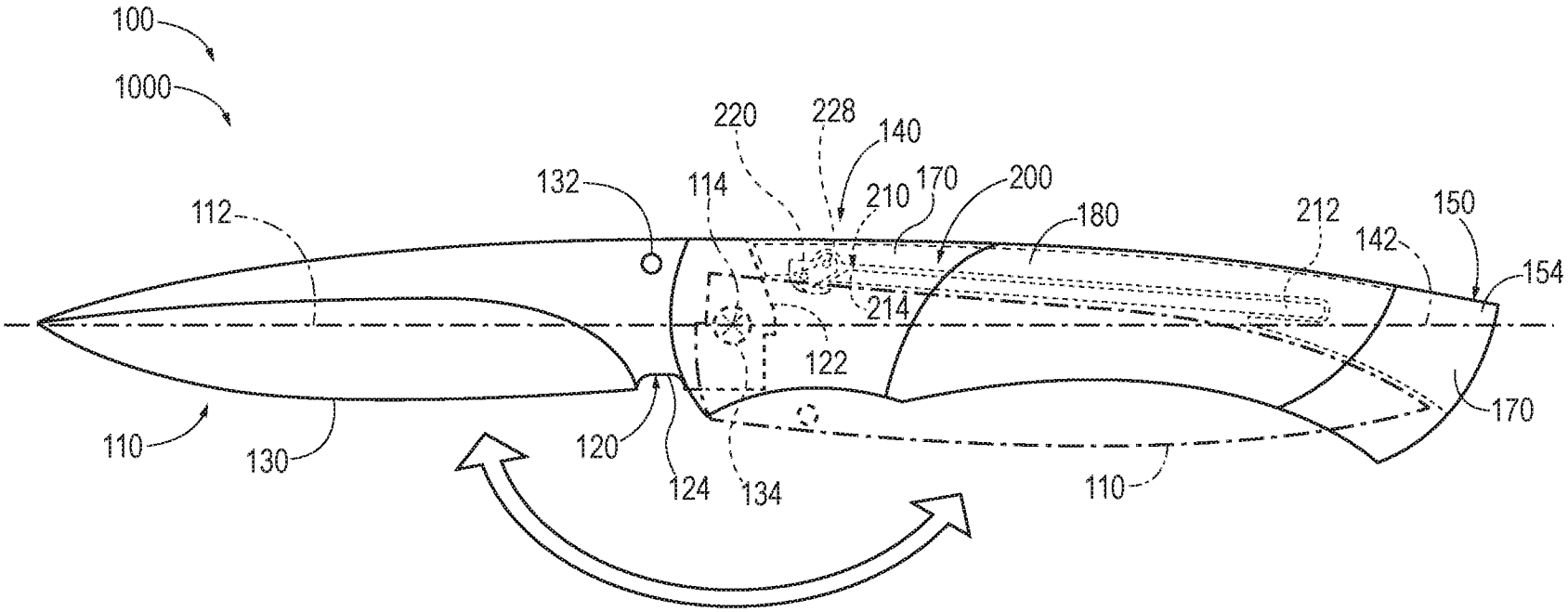
FIG. 8 is a top plan view illustrating the switchblade of FIG. 7 with the blade in each of a folded position and a deployed position according to the present disclosure.
Figure 9:
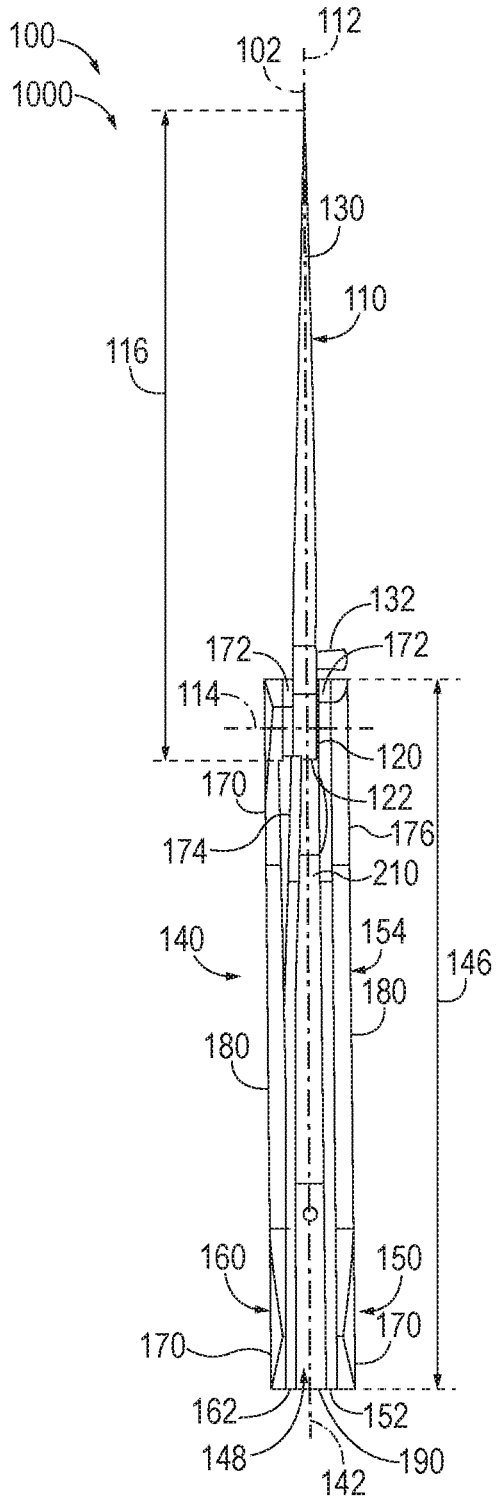
FIG. 9 is a side view illustrating the switchblade of FIGS. 7-8 with the blade in the deployed position.

FIGS. 7-9 are less schematic illustrations of a switchblade 1000, which is an example of switchblade 100 that includes release mechanism 200 as described herein. More specifically, FIG. 8 illustrates switchblade 1000 with blade 110 in each of the folded position (dash-dot lines) and the deployed position (solid lines) and with selected components of handle body 140 and of release mechanism 200 illustrated in dashed hidden lines.

As illustrated in FIGS. 7-9, switchblade 1000 includes backspacer 190 extending between first body portion 150 and second body portion 160. As best illustrated in FIG. 8, backspacer 190 fixedly retains fixed end 212 of release spring 210 within handle body 140, thereby permitting action end 214 of the release spring to flex with respect to the handle body. As further illustrated in FIG. 8, backspacer 190 engages butt 122 of tang 120 of blade 110 when the blade is in the deployed position. FIG. 8 additionally illustrates sear 220 being partially received within sear recess 124 of tang 120 when blade 110 is in the folded position.

As best illustrated in FIG. 9, switchblade 1000 includes lock spring 174 configured to maintain blade 110 in the deployed position. Specifically, and as illustrated in FIG. 9, second liner 162 of switchblade 1000 defines lock spring 174 in the form of a leaf spring that moves toward blade plane 102 to engage butt 122 of tang 120.

Figure 10:
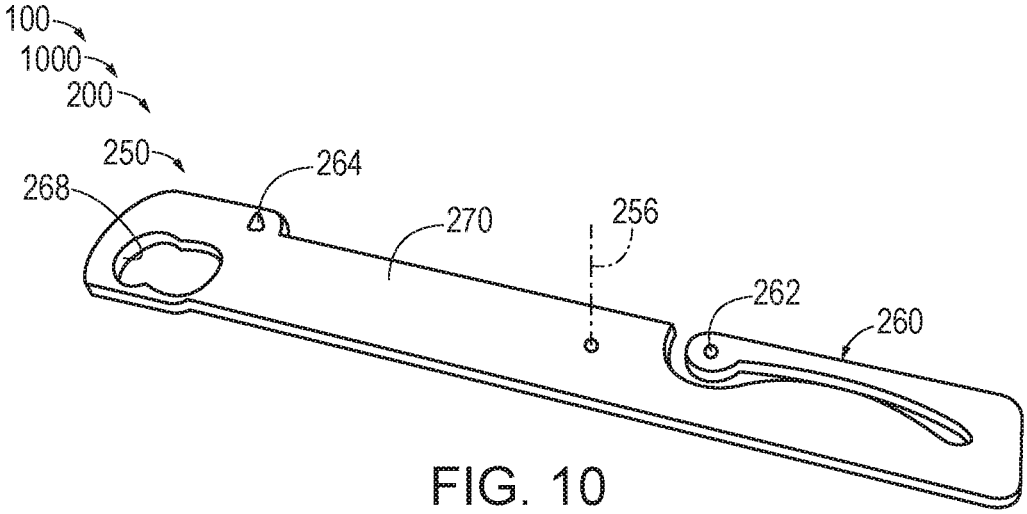
FIG. 10 is a top side perspective view illustrating an actuator of the switchblade of FIGS. 6-9.
Figure 11:
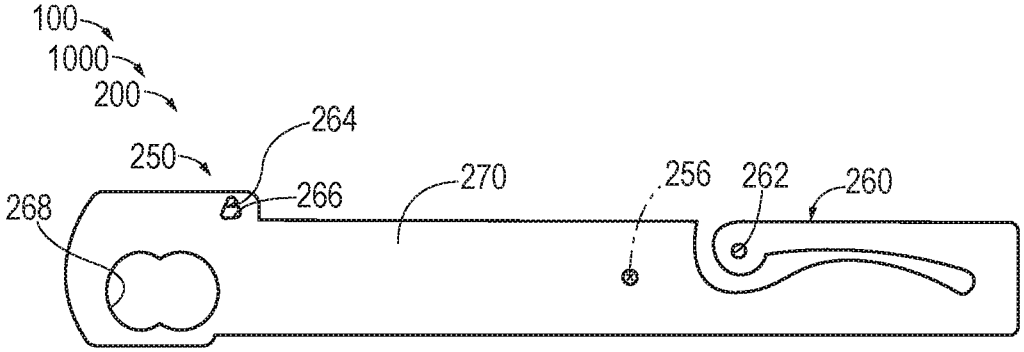
FIG. 11 is a top plan view illustrating the actuator of FIG. 10.

FIGS. 10-13 illustrate selected components of release mechanism 200 of switchblade 1000. Specifically, FIGS. 10-11 illustrate actuator 250 of switchblade 1000, which includes sear drive pin slot 264 that is partially defined by sear drive pin engagement surface 266 (illustrated in FIG.

Figure 12:
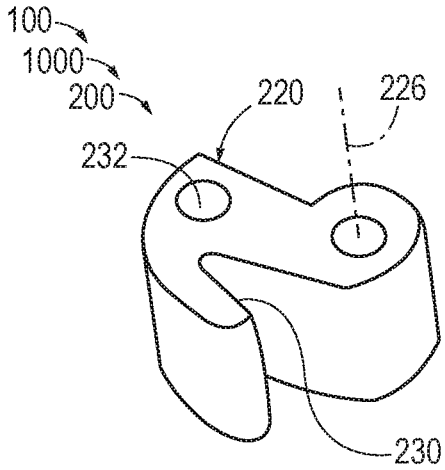
FIG. 12 is a top side perspective view illustrating a sear of the switchblade of FIGS. 6-9.
Figure 13:
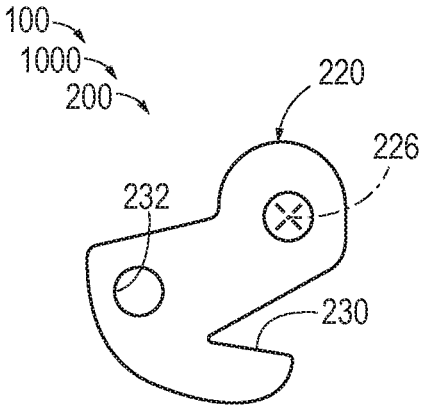
FIG. 13 is a top plan view illustrating the sear of FIG. 12.

11) and that includes blade pivot pin slot 268. FIGS. 12-13 illustrate sear 220 of switchblade 1000.

Examples of switchblades according to the present disclosure are described in the following enumerated paragraphs:

A1. A switchblade, comprising:

a handle body including a first body portion and a second body portion such that each of the first body portion and the second body portion partially defines a blade receiver region between the first body portion and the second body portion;

a blade pivotally coupled to the handle body and having a cutting edge; and a release mechanism for selectively transitioning the blade from a folded position, in which the cutting edge is at least substantially received within the blade receiver region, to a deployed position, in which the cutting edge is exposed and the blade substantially extends from the handle body;

wherein the blade is configured to pivot relative to the handle body about a blade pivot axis to transition the blade between the folded position and the deployed position; wherein the blade extends at least substantially within a blade plane that is at least substantially perpendicular to the blade pivot axis as the blade transitions between the folded position and the deployed position; and wherein the release mechanism includes:

a release spring configured to drive the blade from the folded position to the deployed position, wherein the release spring is configured to be selectively transitioned between a retained configuration and a released configuration, and wherein the release spring is biased toward the released configuration while in the retained configuration;

a sear configured to selectively retain the release spring in the retained configuration, wherein the sear is configured to pivot relative to the handle body about a sear pivot axis that is at least substantially parallel to the blade pivot axis to selectively transition the sear between a retaining position and a releasing position, and wherein the release mechanism is configured to enable the release spring to transition from the retained configuration to the released configuration responsive to the sear transitioning from the retaining position to the releasing position; and an actuator configured to transition the sear from the retaining position to the releasing position, wherein the actuator includes an actuator arm that is configured to move relative to at least a portion of the handle body to selectively transition the actuator between a nominal configuration and an actuated configuration, and wherein the release mechanism is configured to transition the sear from the retaining position to the releasing position responsive to the actuator transitioning from the nominal configuration to the actuated configuration.

A1.1. The switchblade of paragraph A1, wherein the actuator arm is configured to pivot relative to the handle body about an actuator pivot axis to selectively transition the actuator between the nominal configuration and the actuated configuration.

A1.2. The switchblade of any of paragraphs A1-A1.1, wherein the actuator arm is configured to translate relative to the handle body along a direction at least substantially parallel to the blade plane to selectively transition the actuator between the nominal configuration and the actuated configuration.

A1.3. The switchblade of any of paragraphs A1-A1.2, wherein the sear is in the retaining position when the release spring is in the retained configuration.

A1.4. The switchblade of any of paragraphs A1-A1.3, wherein the actuator is in the nominal configuration when the sear is in the retaining position.

A1.5. The switchblade of any of paragraphs A1-A1.4, wherein the sear is configured to pivot about the sear pivot axis relative to the handle body in a first sear pivot direction as the sear transitions from the retaining position to the releasing position, wherein the sear is configured to pivot about the sear axis relative to the handle body in a second sear pivot direction as the sear transitions from the releasing position to the retaining position, wherein the second sear pivot direction is opposite the first sear pivot direction.

A1.6. The switchblade of any of paragraphs A1.1-A1.5, wherein the actuator arm is configured to pivot relative to the handle body in a first actuator pivot direction as the actuator transitions from the nominal configuration to the actuated configuration, wherein the actuator arm is configured to pivot relative to the handle body in a second actuator pivot direction as the actuator transitions from the actuated configuration to the nominal configuration, and wherein the second actuator pivot direction is opposite the first actuator pivot direction.

A1.7. The switchblade of paragraph A1.6, when dependent from paragraph A1.5, wherein the first sear pivot direction is oblique to the first actuator pivot direction.

A2.1. The switchblade of any of paragraphs A1-A1.7, wherein the release mechanism includes a sear drive pin that operates to pivot the sear relative to the handle body about the sear pivot axis responsive to the actuator transitioning from the nominal configuration to the actuated configuration.

A2.2. The switchblade of any of paragraphs A1-A2.1, when dependent from paragraph A1.5, wherein the sear drive pin is configured to transition the sear from the retaining position to the releasing position responsive to the sear drive pin urging the sear in the first sear pivot direction.

A2.3. The switchblade of any of paragraphs A2.1-A2.2, wherein the sear defines a sear drive pin receiver that at least partially receives the sear drive pin.

A2.4 The switchblade of paragraph A2.3, wherein the sear drive pin is at least substantially restricted from translating with respect to the sear drive pin receiver in a direction parallel to the blade plane.

A2.5. The switchblade of any of paragraphs A2.1-A2.4, wherein the sear includes the sear drive pin, and optionally wherein the sear and the sear drive pin are one or more of monolithic, coextensive, and integrally formed.

A2.6. The switchblade of any of paragraphs A2.1-A2.5, wherein the actuator defines a sear drive pin engagement surface that engages the sear drive pin as the actuator transitions from the nominal configuration to the actuated configuration, and wherein the release mechanism is configured such that transitioning the actuator from the nominal configuration to the actuated configuration operates to urge the sear drive pin engagement surface toward the sear drive pin to pivot the sear about the sear pivot axis.

A2.7. The switchblade of paragraph A2.6, wherein the sear drive pin is configured to translate along the sear drive pin engagement surface in a direction at least substantially parallel to the blade plane as the sear transitions between the retaining position and the releasing position.

A2.8. The switchblade of any of paragraphs A2.6-A2.7, wherein the actuator defines a sear drive pin slot that at least partially circumferentially encloses at least a portion of the sear drive pin, and wherein the sear drive pin engagement surface at least partially defines the sear drive pin slot.

A2.9. The switchblade of paragraph A2.8, wherein the sear drive pin slot is configured such that the sear drive pin may translate with respect to the sear drive pin slot in a direction at least substantially parallel to the blade plane while the actuator remains in the nominal configuration.

A2.10. The switchblade of any of paragraphs A2.8-A2.9, wherein the sear drive pin slot is at least substantially triangular.

A2.11. The switchblade of any of paragraphs A2.8-A2.10, wherein the sear is configured to transition from the releasing position to the retaining position at least partially responsive to the sear drive pin slot urging the sear drive pin in the second sear pivot direction.

A2.12. The switchblade of any of paragraphs A2.1-A2.11, wherein the release mechanism includes a sear return spring that biases the sear in the second sear pivot direction, and wherein the sear is configured to transition from the releasing position to the retaining position at least partially responsive to the sear return spring urging the sear in the second sear pivot direction.

A2.13. The switchblade of any of paragraphs A2.1-A2.12, wherein the handle body includes a sear drive pin hole through which the sear drive pin at least partially extends, and wherein the sear drive pin engages an edge of the sear drive pin hole when the sear is in one or both of the retaining position and the releasing position to at least partially define a range of motion of the actuator arm corresponding to releasing the blade from the folded position to the deployed position.

A2.14. The switchblade of any of paragraphs A1-A2.13, wherein the sear is configured to transition from the retaining position to the releasing position responsive to the release spring transitioning from the released configuration toward the retained configuration.

A2.15. The switchblade of any of paragraphs A1-A2.14, wherein the sear is configured to transition from the retaining position to the releasing position while the actuator remains in the nominal configuration.

A2.16. The switchblade of any of paragraphs A1-A2.15, wherein the sear is configured to transition from the releasing position to the retaining position while the actuator remains in the nominal configuration.

A2.17. The switchblade of any of paragraphs A1-A2.16, wherein the release mechanism further includes a sear safety mechanism configured to selectively restrict the sear from being transitioned from the retaining position to the releasing position.

A3.1. The switchblade of any of paragraphs A1-A2.15, wherein the switchblade further includes a blade pivot pin that extends through the blade along the blade pivot axis and that operatively couples the blade to the handle body.

A3.2. The switchblade of paragraph A3.1, wherein the blade includes a tang that extends within the handle body when the blade is in the deployed position, and wherein the blade pivot pin extends through the tang.

A3.3. The switchblade of any of paragraphs A3.1-A3.2, wherein the blade pivot pin is directly coupled to at least one of the first body portion and the second body portion.

A3.4. The switchblade of any of paragraphs A3.1-A3.3, wherein the blade pivot pin extends at least partially, and optionally fully, into at least one of the first body portion and the second body portion.

A3.5. The switchblade of any of paragraphs A3.1-A3.4, wherein the blade pivot pin is concealed from view from exterior the switchblade.

A3.6. The switchblade of any of paragraphs A1-A3.5, wherein the switchblade further includes a sear pivot pin that extends through the sear along the sear pivot axis and that operatively couples the sear to the handle body.

A3.7. The switchblade of paragraph A3.6, wherein the sear pivot pin is directly coupled to at least one of the first body portion and the second body portion.

A3.8. The switchblade of any of paragraphs A3.6-A3.7, wherein the sear pivot pin extends at least partially, and optionally fully, into at least one of the first body portion and the second body portion.

A3.9. The switchblade of any of paragraphs A3.6-A3.8, wherein the sear pivot pin extends at least partially into each of the first body portion and the second body portion, and wherein the sear pivot pin supports the sear within the blade receiver region.

A3.10. The switchblade of any of paragraphs A3.6-A3.9, wherein the sear pivot pin is concealed from view from exterior the switchblade.

A3.11. The switchblade of any of paragraphs A1.1-A3.10, wherein the release mechanism further includes an actuator fastener that extends at least partially through the actuator along the actuator pivot axis to operatively couple the actuator to the handle body.

A3.12. The switchblade of paragraph A3.11, wherein the actuator fastener is directly coupled to at least one of the first body portion and the second body portion.

A3.13. The switchblade of any of paragraphs A3.11-A3.12, wherein the actuator fastener extends at least partially, and optionally fully, into at least one of the first body portion and the second body portion.

A3.14. The switchblade of any of paragraphs A3.11-A3.13, wherein the actuator fastener is concealed from view from exterior the switchblade.

A3.15. The switchblade of any of paragraphs A3.11-A3.14, wherein the actuator fastener includes one or more of a pin, a screw, and a shoulder screw.

A4.1. The switchblade of any of paragraphs A1-A3.15, wherein the release spring stores a greater spring potential energy while in the retained configuration than while in the released configuration.

A4.2. The switchblade of any of paragraphs A1-A4.1, wherein the release spring is at least one of a flat spring, a cantilever spring, and a leaf spring.

A4.3. The switchblade of any of paragraphs A1-A4.2, wherein the release spring includes a fixed end that is fixedly coupled to the handle body and an action end that engages the blade to transition the blade from the folded position to the deployed position.

A4.4. The switchblade of paragraph A4.3, wherein the sear includes a spring catch configured to engage the action end of the release spring when the release spring is in the retained configuration.

A4.5. The switchblade of any of paragraphs A4.3-A4.4, wherein, when the release spring is in the retained configuration, the action end of the release spring biases the sear in the second sear pivot direction.

A5.1. The switchblade of any of paragraphs A1-A4.5, wherein the actuator includes, and optionally is, an actuator plate that extends at least substantially parallel to the blade plane.

A5.2. The switchblade of any of paragraphs A1-A5.1, when dependent from paragraph A3.1, wherein the actuator defines a blade pivot pin slot, wherein the blade pivot pin extends through the blade pivot pin slot.

A5.3. The switchblade of paragraph A5.2, wherein the blade pivot pin slot is configured to move with respect to the blade pivot pin and in a direction at least substantially parallel to the blade plane as the actuator transitions between the nominal configuration and the actuated configuration.

A5.4. The switchblade of any of paragraphs A5.2-A5.3, wherein the blade pivot pin engages a portion of a perimeter of the blade pivot pin slot when the actuator is in at least one of the nominal configuration and the actuated configuration.

A5.5. The switchblade of any of paragraphs A5.2-A5.4, wherein the switchblade further includes a blade pivot pin retainer configured to at least partially retain the blade pivot pin in position with respect to the handle body.

A5.6. The switchblade of paragraph A5.5, wherein the blade pivot pin retainer extends within the blade pivot pin.

A5.7. The switchblade of any of paragraphs A5.5-A5.6, wherein the blade pivot pin includes the blade pivot pin retainer.

A5.8. The switchblade of any of paragraphs A5.5-A5.7, wherein the blade pivot pin retainer has a diameter that is greater than a linear dimension of the blade pivot pin slot such that the blade pivot pin retainer at least partially restricts the actuator from moving with respect to the blade pivot pin in a direction parallel to the blade pivot axis.

A5.9. The switchblade of any of paragraphs A1-A5.8, wherein the actuator includes an actuator return spring configured to bias the actuator toward the nominal configuration.

A5.10. The switchblade of paragraph A5.9, wherein the actuator at least partially defines the actuator return spring.

A5.11. The switchblade of any of paragraphs A5.9-A5.10, wherein the actuator return spring is at least one of a flat spring, a cantilever spring, and a leaf spring.

A5.12. The switchblade of any of paragraphs A5.9-A5.11, wherein the actuator return spring includes a return spring attachment point that remains at least substantially fixed relative to the handle body as the actuator transitions between the nominal configuration and the actuated configuration.

A5.13. The switchblade of paragraph A5.12, wherein the return spring attachment point is at least substantially fixed relative to the handle body via one or more of a fastener, a pin, a screw, and a shoulder screw.

A6.1. The switchblade of any of paragraphs A1-A5.13 wherein the handle body is a monolithic handle body that includes the first body portion and the second body portion.

A6.2. The switchblade of any of paragraphs A1-A5.13, wherein the first body portion and the second body portion are distinct components that are operatively coupled to one another to at least partially form the handle body.

A6.3. The switchblade of any of paragraphs A1.1-A6.2, wherein the first body portion includes an actuator grip that is fixedly coupled to the actuator; and wherein the actuator grip is configured to be manually pivoted about the actuator pivot axis by a user to transition the actuator from the nominal configuration to the actuated configuration.

A6.4. The switchblade of any of paragraphs A1-A6.3, wherein at least one of the first body portion and the second body portion includes at least one bolster configured to reinforce the handle body.

A6.5. The switchblade of paragraph A6.4, wherein each bolster is configured to be gripped by a user.

A6.6. The switchblade of any of paragraphs A1-A6.5, wherein at least one of the first body portion and the second body portion includes at least one scale configured to be gripped by a user.

A6.7. The switchblade of paragraph A6.6, when dependent from paragraph A6.4, wherein at least one of the first body portion and the second body portion includes the at least one scale positioned between two bolsters.

A6.8. The switchblade of paragraph A6.7, wherein the scale is fixedly coupled to each bolster.

A6.9. The switchblade of any of paragraphs A6.6-A6.8, when dependent from paragraphs A6.3 and A6.4, wherein the actuator grip includes at least one bolster and at least one scale.

A6.10. The switchblade of paragraph A6.9, wherein the actuator grip includes one scale positioned between two bolsters.

A6.11. The switchblade of any of paragraphs A1-A6.10, wherein at least one of the first body portion and the second body portion includes a liner that at least partially defines the blade receiver region.

A6.12. The switchblade of paragraph A6.11, wherein the liner is a first liner of the first body portion, wherein the second body portion includes a second liner, and wherein the first liner and the second liner are positioned on opposite sides of the cutting edge of the blade when the blade is in the folded position.

A6.13. The switchblade of paragraph A6.12, when dependent from paragraph A6.3, wherein the actuator grip is configured to pivot relative to the first liner as the actuator transitions between the nominal configuration and the actuated configuration.

A6.14. The switchblade of any of paragraphs A6.12-A6.13, wherein the sear is positioned between the first liner and the second liner.

A6.15. The switchblade of any of paragraphs A6.12-A6.14, wherein the sear and the actuator are positioned on opposite sides of the first liner.

A6.16. The switchblade of any of paragraphs A6.12-A6.15, wherein at least one of the first liner and the second liner includes, and optionally defines, a lock spring configured to retain the blade in the deployed position.

A6.17. The switchblade of paragraph A6.16, wherein the lock spring is configured to automatically retain the blade in the deployed position when the blade reaches the deployed position, and wherein the lock spring is configured to be selectively manipulated to permit the blade to transition from the deployed position to the folded position.

A6.18. The switchblade of any of paragraphs 6.16-A6.17, wherein the lock spring is biased toward the blade plane, and wherein, when the blade is in the deployed position, the lock spring moves toward the blade plane to engage a butt of a/the tang of the blade to retain the blade in the deployed position.

A6.19. The switchblade of any of paragraphs A6.16-A6.18, wherein the lock spring is configured to be manually moved away from the blade plane to permit the blade to transition from the deployed position to the folded position.

A6.20. The switchblade of any of paragraphs A6.16-A6.19, wherein the lock spring is at least one of a flat spring, a cantilever spring, and a leaf spring.

A6.21. The switchblade of any of paragraphs A1-A6.20, wherein the first body portion defines an actuator pocket that at least substantially encloses the actuator.

A6.22. The switchblade of any of paragraphs A1-A6.21, when dependent from paragraph A3.11, wherein the actuator fastener extends at least partially, and optionally fully, through at least one of a/the actuator pocket, a/the actuator grip, and a/the first liner.

A6.23. The switchblade of any of paragraphs A1-A6.22, wherein the handle body includes a backspacer that extends between the first body portion and the second body portion to maintain the first body portion and the second body portion in a spaced-apart orientation.

A6.24. The switchblade of paragraph A6.23, wherein the backspacer partially defines the blade receiver region.

A6.25. The switchblade of any of paragraphs A6.23-A6.24, wherein the backspacer fixedly retains a/the fixed end of the release spring within the handle body.

A6.26. The switchblade of any of paragraphs A6.23-A6.25, wherein the backspacer engages a/the butt of a/the tang of the blade when the blade is in the deployed position.

A7.1. The switchblade of any of paragraphs A1-A6.26, further comprising a thumb stud operatively coupled to the blade to facilitate manually transitioning the blade from the folded position to the deployed position.

A7.2. The switchblade of paragraph A7.1, wherein the thumb stud extends away from the blade plane.

A7.3. The switchblade of any of paragraphs A3.2-A7.2, wherein the tang of the blade defines a sear recess that at least partially receives the sear when the blade is in the folded position.

A8.1. The switchblade of any of paragraphs A1-A7.3, wherein the blade has a blade length, as measured along a direction parallel to a blade longitudinal axis of the blade, and wherein the blade length is at least one of at least 5 centimeters (cm), at least 10 cm, at least 15 cm, at least 20 cm, at most 25 cm, at most 17 cm, at most 12 cm, and at most 7 cm.

A8.2. The switchblade of any of paragraphs A1-A8.1, wherein the handle body has a handle body length, as measured along a direction parallel to a handle longitudinal axis of the handle body, and wherein the handle body length is at least one of at least 5 cm, at least 10 cm, at least 15 cm, at least 20 cm, at most 25 cm, at most 17 cm, at most 12 cm, and at most 7 cm.

A8.3. The switchblade of any of paragraphs A1-A8.2, wherein a/the blade longitudinal axis and a/the handle longitudinal axis are at least substantially parallel when the blade is in the folded position.

A8.4. The switchblade of any of paragraphs A1-A8.3, wherein a/the blade longitudinal axis and a/the handle longitudinal axis are at least substantially parallel when the blade is in the deployed position.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A switchblade, comprising:

a handle body including a first body portion and a second body portion such that each of the first body portion and the second body portion partially defines a blade receiver region between the first body portion and the second body portion;

a blade pivotally coupled to the handle body and having a cutting edge; and a release mechanism for selectively transitioning the blade from a folded position, in which the cutting edge is at least substantially received within the blade receiver region, to a deployed position, in which the cutting edge is exposed and the blade substantially extends from the handle body;

wherein the blade is configured to pivot relative to the handle body about a blade pivot axis to transition the blade between the folded position and the deployed position; wherein the blade extends at least substantially within a blade plane that is at least substantially perpendicular to the blade pivot axis as the blade transitions between the folded position and the deployed position; and wherein the release mechanism includes:

a release spring configured to drive the blade from the folded position to the deployed position, wherein the release spring is configured to be selectively transitioned between a retained configuration and a released configuration, and wherein the release spring is biased toward the released configuration while in the retained configuration;

a sear configured to selectively retain the release spring in the retained configuration, wherein the sear is configured to pivot relative to the handle body about a sear pivot axis that is at least substantially parallel to the blade pivot axis to selectively transition the sear between a retaining position and a releasing position, wherein the sear is configured to pivot about the sear pivot axis relative to the handle body in a first sear pivot direction as the sear transitions from the retaining position to the releasing position, wherein the sear is configured to pivot about the sear pivot axis relative to the handle body in a second sear pivot direction as the sear transitions from the releasing position to the retaining position, and wherein the release mechanism is configured to enable the release spring to transition from the retained configuration to the released configuration responsive to the sear transitioning from the retaining position to the releasing position;

an actuator configured to transition the sear from the retaining position to the releasing position, wherein the actuator includes an actuator arm that is configured to move relative to at least a portion of the handle body to selectively transition the actuator between a nominal configuration and an actuated configuration, and wherein the release mechanism is configured to transition the sear from the retaining position to the releasing position responsive to the actuator transitioning from the nominal configuration to the actuated configuration; and a sear drive pin that operates to pivot the sear relative to the handle body about the sear pivot axis responsive to the actuator transitioning from the nominal configuration to the actuated configuration, wherein the actuator defines a sear drive pin engagement surface that engages the sear drive pin as the actuator transitions from the nominal configuration to the actuated configuration, and wherein the release mechanism is configured such that transitioning the actuator from the nominal configuration to the actuated configuration operates to urge the sear drive pin engagement surface toward the sear drive pin to pivot the sear about the sear pivot axis.

2. The switchblade of claim 1, wherein the actuator arm is configured to translate relative to the handle body along a direction at least substantially parallel to the blade plane to selectively transition the actuator between the nominal configuration and the actuated configuration.

3. The switchblade of claim 1, wherein the actuator arm is configured to pivot relative to the handle body about an actuator pivot axis to selectively transition the actuator between the nominal configuration and the actuated configuration.

4. The switchblade of claim 3, wherein the actuator arm is configured to pivot relative to the handle body in a first actuator pivot direction as the actuator transitions from the nominal configuration to the actuated configuration, wherein the actuator arm is configured to pivot relative to the handle body in a second actuator pivot direction as the actuator transitions from the actuated configuration to the nominal configuration, and wherein the second actuator pivot direction is opposite the first actuator pivot direction.

5. The switchblade of claim 4, wherein the first sear pivot direction is oblique to the first actuator pivot direction.

6. The switchblade of claim 1, wherein the sear drive pin is configured to translate along the sear drive pin engagement surface in a direction at least substantially parallel to the blade plane as the sear transitions between the retaining position and the releasing position.

7. The switchblade of claim 1, wherein the actuator defines a sear drive pin slot that at least partially circumferentially encloses at least a portion of the sear drive pin, wherein the sear drive pin engagement surface at least partially defines the sear drive pin slot, and wherein the sear drive pin slot is configured such that the sear drive pin may translate with respect to the sear drive pin slot in a direction at least substantially parallel to the blade plane while the actuator remains in the nominal configuration.

8. The switchblade of claim 1, wherein the handle body includes a sear drive pin hole through which the sear drive pin at least partially extends, and wherein the sear drive pin engages an edge of the sear drive pin hole when the sear is in one or both of the retaining position and the releasing position to at least partially define a range of motion of the actuator arm corresponding to releasing the blade from the folded position to the deployed position.

9. The switchblade of claim 1, wherein the sear is configured to transition from the retaining position to the releasing position responsive to the release spring transitioning from the released configuration toward the retained configuration, wherein the sear is configured to transition from the retaining position to the releasing position while the actuator remains in the nominal configuration, and wherein the sear is configured to transition from the releasing position to the retaining position while the actuator remains in the nominal configuration.

10. The switchblade of claim 1, wherein the switchblade further includes a sear pivot pin that extends through the sear along the sear pivot axis and that operatively couples the sear to the handle body, wherein the sear pivot pin extends at least partially into each of the first body portion and the second body portion, and wherein the sear pivot pin supports the sear within the blade receiver region.

11. The switchblade of claim 1, wherein the release spring includes a fixed end that is fixedly coupled to the handle body and an action end that engages the blade to transition the blade from the folded position to the deployed position.

12. The switchblade of claim 11, wherein, when the release spring is in the retained configuration, the action end of the release spring biases the sear in the second sear pivot direction.

13. The switchblade of claim 1, wherein the actuator includes an actuator return spring configured to bias the actuator toward the nominal configuration.

14. The switchblade of claim 13, wherein the actuator return spring includes a return spring attachment point that remains at least substantially fixed relative to the handle body as the actuator transitions between the nominal configuration and the actuated configuration.

15. The switchblade of claim 1, wherein the first body portion includes a first liner, wherein the second body portion includes a second liner, wherein each of the first liner and the second liner partially defines the blade receiver region, and wherein the sear is positioned between the first liner and the second liner.

16. The switchblade of claim 15, wherein the sear and the actuator are positioned on opposite sides of the first liner.

17. The switchblade of claim 15, wherein at least one of the first liner and the second liner includes a lock spring configured to retain the blade in the deployed position.

18. The switchblade of claim 17, wherein the lock spring is biased toward the blade plane, and wherein, when the blade is in the deployed position, the lock spring moves toward the blade plane to engage the blade to retain the blade in the deployed position, and wherein the lock spring is configured to be manually moved away from the blade plane to permit the blade to transition from the deployed position to the folded position.

19. A switchblade, comprising:

a handle body including a first body portion and a second body portion such that each of the first body portion and the second body portion partially defines a blade receiver region between the first body portion and the second body portion;

a blade pivotally coupled to the handle body and having a cutting edge; and a release mechanism for selectively transitioning the blade from a folded position, in which the cutting edge is at least substantially received within the blade receiver region, to a deployed position, in which the cutting edge is exposed and the blade substantially extends from the handle body;

wherein the blade is configured to pivot relative to the handle body about a blade pivot axis to transition the blade between the folded position and the deployed position; wherein the blade extends at least substantially within a blade plane that is at least substantially perpendicular to the blade pivot axis as the blade transitions between the folded position and the deployed position; and wherein the release mechanism includes:

a release spring configured to drive the blade from the folded position to the deployed position, wherein the release spring is configured to be selectively transitioned between a retained configuration and a released configuration, and wherein the release spring is biased toward the released configuration while in the retained configuration;

a sear configured to selectively retain the release spring in the retained configuration, wherein the sear is configured to pivot relative to the handle body about a sear pivot axis that is at least substantially parallel to the blade pivot axis to selectively transition the sear between a retaining position and a releasing position, wherein the sear is configured to pivot about the sear pivot axis relative to the handle body in a first sear pivot direction as the sear transitions from the retaining position to the releasing position, wherein the sear is configured to pivot about the sear pivot axis relative to the handle body in a second sear pivot direction as the sear transitions from the releasing position to the retaining position, and wherein the release mechanism is configured to enable the release spring to transition from the retained configuration to the released configuration responsive to the sear transitioning from the retaining position to the releasing position; and an actuator configured to transition the sear from the retaining position to the releasing position, wherein the actuator includes an actuator arm that is configured to move relative to at least a portion of the handle body to selectively transition the actuator between a nominal configuration and an actuated configuration, and wherein the release mechanism is configured to transition the sear from the retaining position to the releasing position responsive to the actuator transitioning from the nominal configuration to the actuated configuration;

wherein the sear is configured to transition from the retaining position to the releasing position responsive to the release spring transitioning from the released configuration toward the retained configuration, wherein the sear is configured to transition from the retaining position to the releasing position while the actuator remains in the nominal configuration, and wherein the sear is configured to transition from the releasing position to the retaining position while the actuator remains in the nominal configuration.

20. The switchblade of claim 19, wherein the release mechanism includes a sear return spring that biases the sear in the second sear pivot direction, and wherein the sear is configured to transition from the releasing position to the retaining position at least partially responsive to the sear return spring urging the sear in the second sear pivot direction.

* * * * *